US008356731B2

(12) United States Patent
Xiao et al.

(10) Patent No.: US 8,356,731 B2
(45) Date of Patent: Jan. 22, 2013

(54) ENERGY SAVING BAFFLE FOR WATER COOLER

(75) Inventors: Tony Xiao, Shenzhen Guangdong (CN); Chun Yen Wang, El Paso, TX (US)

(73) Assignee: MTN Products Inc, LaVerne, CA (US)

( * ) Notice: Subject to any disclaimer, the term of this patent is extended or adjusted under 35 U.S.C. 154(b) by 656 days.

(21) Appl. No.: 12/555,866

(22) Filed: Sep. 9, 2009

(65) Prior Publication Data

US 2011/0056981 A1 Mar. 10, 2011

(51) Int. Cl.
*B67D 1/00* (2006.01)

(52) U.S. Cl. ..... 222/67; 222/64; 222/146.1; 222/146.2; 222/146.6

(58) Field of Classification Search ..... 222/64, 222/67, 146.1–146.2, 146.6
See application file for complete search history.

(56) References Cited

U.S. PATENT DOCUMENTS 1,241,352 A 1/1917 Doering et al.
1,248,705 A 12/1917 Pogue
1,319,376 A 4/1919 Cooper
1,337,206 A 4/1920 Doering et al.
1,628,853 A * 5/1927 Lomax ..... 222/146.6
1,960,604 A 5/1933 Van Fleet
1,933,192 A 10/1933 Taylor
1,948,644 A 2/1934 Blood et al.
1,976,007 A 10/1934 Cullen et al.
2,057,238 A 10/1936 Krug
2,072,629 A 3/1937 Femholz
2,689,669 A 9/1954 Ericson
2,811,272 A 10/1957 Lawlor
2,998,164 A * 8/1961 Clements ..... 222/146.6
3,033,247 A 5/1962 Beall, Jr.
3,193,143 A 7/1965 Maieli
3,207,190 A 9/1965 Silbereis et al.
3,250,433 A * 5/1966 Christine et al. ..... 222/131
3,326,417 A * 6/1967 Tinsley ..... 222/54
3,341,073 A 9/1967 Arps et al.
3,351,239 A * 11/1967 Flock ..... 222/54
3,352,460 A * 11/1967 Herring ..... 222/129.4
3,540,402 A 11/1970 Kocher
3,606,096 A 9/1971 Campbell
3,768,501 A 10/1973 Elson et al.
3,774,658 A 11/1973 Abramoska, Jr.
3,802,606 A 4/1974 Gust
3,843,021 A 10/1974 Schieser
3,892,235 A 7/1975 Van Amerongen et al.
3,893,599 A 7/1975 Birell
3,915,341 A * 10/1975 Brown ..... 222/67
3,920,149 A 11/1975 Fortino et al.

(Continued)

OTHER PUBLICATIONS

Ebac Eddy Water Cooler for the Home: Discount Store UK.; Ebac Eddy is a Refreshing New Way to Enjoy a Healthy Lifestyle; http://www.freenet.ltd.u/ebac_eddy.asp.

(Continued)

*Primary Examiner* — Frederick C. Nicolas
(74) *Attorney, Agent, or Firm* — Michael P Mazza, LLC

(57) ABSTRACT

A water cooler assembly and/or liquid dispensing apparatus and method for using same, including an energy-saving baffle, which may take the form of a conventional or bottom load water cooler. Additionally, various other, alternative features may be included, such as: a door stop mechanism; an adjustable drip tray assembly; a leak stop mechanism; an adjustable bottle interface accommodating dimensional variations in water bottles; an instaboil feature; and various programmable dispensing and visual display modes.

3 Claims, 26 Drawing Sheets

U.S. PATENT DOCUMENTS 3,966,093 A 6/1976 Frahm et al.
3,973,602 A 8/1976 Kruse
3,974,863 A 8/1976 Frahm et al.
3,993,218 A 11/1976 Reichenberger
4,124,146 A 11/1978 Sealfon
4,133,354 A * 1/1979 Lerner et al. ..... 141/18
4,137,930 A 2/1979 Scholle
4,239,130 A 12/1980 Altadonna
4,244,467 A 1/1981 Cavazza
4,267,945 A 5/1981 Maynard
4,356,848 A 11/1982 Spies
4,421,146 A 12/1983 Bond et al.
4,444,340 A 4/1984 Bond et al.
4,445,551 A 5/1984 Bond et al.
4,597,423 A 7/1986 Chenot
4,699,188 A 10/1987 Baker et al.
4,711,380 A 12/1987 Ulm
4,717,051 A 1/1988 Leclerc
4,722,463 A 2/1988 Anderson
4,793,514 A 12/1988 Sheets
4,834,267 A 5/1989 Schroer et al.
4,846,236 A 7/1989 Deruntz
4,874,023 A 10/1989 Ulm
4,881,380 A * 11/1989 Mrugala et al. ..... 62/389
4,898,308 A 2/1990 Rudick
4,902,320 A 2/1990 Schroer
4,972,976 A 11/1990 Romero
4,991,635 A 2/1991 Ulm
5,031,676 A 7/1991 Ulm
5,121,778 A 6/1992 Baker et al.
5,133,482 A 7/1992 Burrows et al.
5,213,309 A 5/1993 Makishima
5,222,530 A 6/1993 Baker et al.
5,222,531 A 6/1993 Baker et al.
5,232,125 A 8/1993 Adams
5,259,534 A 11/1993 Lynd
5,273,083 A 12/1993 Burrows
5,289,854 A 3/1994 Baker et al.
5,289,855 A 3/1994 Baker et al.
5,295,518 A 3/1994 Baker et al.
5,295,519 A 3/1994 Baker et al.
5,337,922 A 8/1994 Salkeld et al.
5,395,590 A 3/1995 Swaniger
5,413,152 A 5/1995 Burrows
5,431,205 A 7/1995 Gebhard
5,454,409 A 10/1995 McAffer et al.
5,464,127 A 11/1995 Burrows
5,526,961 A 6/1996 Burrows
5,533,651 A 7/1996 Eddy et al.
5,647,416 A 7/1997 Desrosiers et al.
5,653,270 A 8/1997 Burrows
5,676,278 A 10/1997 Bever et al.
5,711,380 A 1/1998 Chen
5,911,341 A * 6/1999 Donselman et al. ..... 222/129
5,957,316 A 9/1999 Hidding et al.
6,029,860 A 2/2000 Donselman
6,167,921 B1 1/2001 Busick et al.
6,209,753 B1 * 4/2001 Ohu ..... 222/64
6,786,255 B1 * 9/2004 Lee ..... 141/351
6,793,099 B1 * 9/2004 Sleiman ..... 222/67
6,871,675 B1 * 3/2005 Marszalec et al. ..... 141/82
2008/0054017 A1 * 3/2008 Wang et al. ..... 222/64

OTHER PUBLICATIONS

Watercoolers—Ebac Limited—Group Website. Manufacturer of dehumidifiers and water . . . ; Ebac Group; Watercoolers; http://www.ebacgroup.com/?pae=21.

Latest News—Ebac Limited—Group Website. Manufacturer of dehumidifiers and water c . . . ; Ebac Group; Latest News; Ebac enters point of use market; http://www.ebacgroup.com/?page=36&art=22.

Home Spring Photos (14 images); http://henry-design.com/temp/mtn0503/060406_home_spring_photos/index.html.

* cited by examiner 060503 reboil test

3

Hot Tank Water TC's in Deg C (LEFT AXIS) & Steam Vol. in INCHES (RIGHT AXIS) versus Time

ENERGY SAVING BAFFLE FOR WATER COOLER

COPENDING APPLICATIONS INCORPORATED BY REFERENCE

Co-pending U.S. Ser. No. 11/382,114 filed May 8, 2006 and titled "Bottle Cap And Method Of Use With A Liquid Dispensing Apparatus And System" ("the Bottle Cap Invention"), co-pending U.S. Ser. No. 11/468,342, filed Aug. 30, 2006 and titled "Liquid Dispensing Apparatus And System ("the Liquid Dispensing Invention"), are each hereby incorporated by reference in their entirety into this disclosure.

BACKGROUND OF THE INVENTION

The present invention generally relates to water cooler assemblies and liquid dispensing apparatus. More specifically, the invention relates to an energy saving baffle for use with such assemblies and apparatus, which may but need not also employ or embody various other features, including: a bottom load water cooler, including such a cooler with a door stop mechanism; an adjustable drip tray assembly; a leak stop mechanism; an adjustable bottle interface accommodating dimensional variations in water bottles; an instaboil feature; and programmable dispensing and visual display modes.

Experience in the water cooler and liquid dispensing industry has shown that water cooler assemblies and liquid dispensing apparatus with one or more of the above-referenced features would be advantageous.

SUMMARY OF THE INVENTION

The objects mentioned above, as well as other objects, are solved by the present invention, which overcomes disadvantages of prior water cooler assemblies and liquid dispensing apparatus, while providing new advantages not believed associated with such assemblies and apparatus.

In a preferred embodiment of the invention, a liquid dispensing apparatus is provided which includes cold and hot tanks in liquid communication therebetween and with a dispensing faucet. The cold tank houses a baffle for separating two or more regions of liquid in the cold tank having differing temperatures. The baffle is in liquid communication with a tube communicating between the cold and hot tanks. The baffle tube houses a ball with a specific density less than the specific density of the liquid, such that the ball normally floats upward within the baffle tube to partially seal against a retaining member within the baffle tube and thereby restrict liquid circulation between the hot and cold tanks. For this purpose, an upper retaining member may preferably include an opening, such as one or more slotted apertures, to facilitate the partial seal of the ball against the upper retaining member.

Preferably, the hot tank is located below the cold tank, and following liquid discharge from the hot tank, the ball is pushed downwardly within the baffle tube by liquid flowing from the cold tank to replenish the hot tank.

The energy saving baffle described immediately above will save on energy costs, as liquid from the cold and hot tanks will only interchange when the hot tank is required to be replenished. This energy saving baffle may be used with liquid dispensing apparatus having a variety of other features, which are the subject of other, pending patent applications, and which are now described.

In another preferred embodiment, the above-referenced liquid dispensing apparatus may be provided with a supporting frame and a water bottle carried by the supporting frame and located below the dispensing mechanism during normal use. In this embodiment, the liquid dispensing apparatus may also include a pivotable door which may be opened for loading the water bottle, and wherein upon closure a stop mechanism is engaged, substantially reducing a swinging weight of the water bottle-door combination during its pivotable rotation toward an open position. The stop mechanism may be located on the supporting frame of the apparatus, and may engage a bottle retaining member of the apparatus, causing the bottle retaining member to deform.

In an alternative embodiment, the liquid dispensing apparatus with energy-saving baffle may also be provided with an adjustable drip tray assembly having a leakage compartment for storing spilled liquid, and providing a support surface for supporting a vessel to be filled with liquid. Preferably, the adjustable drip tray assembly is capable of moving between a retracted position providing a first support surface for supporting conventional-sized vessels, and an extended position providing a second, enlarged support surface for supporting substantially larger vessels than when the adjustable drip tray assembly is in the retracted position. In the preferred embodiment, when the adjustable drip tray assembly is in the extended position, spilled liquid may be permitted to flow through a channel that funnels liquid from the support surface to the leakage compartment. The adjustable drip tray assembly may also be provided with a visual display indicating when the leakage compartment should be emptied. The assembly may include a pivotable platform which, when in the raised condition, has a top, first surface and a rear, second surface substantially larger than the first surface. The platform may also include a hollow space for accommodating at least a portion of the leakage compartment. When the platform is pivoted to the raised condition, the platform may cover the leakage compartment.

In yet another alternative embodiment, the above-referenced liquid dispensing apparatus with energy-saving baffle may be enabled to dispense liquid in a conventional dispensing mode in which liquid is dispensed as long as a user depresses a button or lever, and also in a measured fill dispensing mode permitting the user to preselect a predetermined volume of liquid to be dispensed. The measured fill dispensing mode may use various dispensing approaches, including a time-based approach, a flowmeter-based approach, and a weight-sensor-based approach.

In still another alternative embodiment, the above-referenced liquid dispensing apparatus with energy-saving baffle may also include a supporting frame and a liquid-containing bottle in fluid communication with a dispensing mechanism. A neck of the bottle interfaces with a cap and a hollow probe with a bottle guide. The bottle guide supports the bottle, and the cap and hollow probe enable liquid to flow from the bottle to the dispensing mechanism. A leak stop mechanism having sealing locations may be provided, creating liquid-tight seals between the bottle guide and the cap. The leak stop mechanism may be made of an elastomeric material, such as silicone rubber. A tight seal may be created by the weight of the bottle pressing down on the sealing locations.

In an alternative embodiment, the liquid dispensing apparatus with energy-saving baffle described above may include a supporting frame carrying bottle retaining members and a liquid-containing bottle in fluid communication with a dispensing mechanism. A neck of the bottle interfaces with a cap and a hollow probe with a bottle guide. The bottle guide supports the bottle, and the cap and hollow probe enable the liquid to flow from the bottle to the dispensing mechanism. The bottle guide and the hollow probe are movable with respect to the bottle retaining members to accommodate dimensional variations of different bottles.

In a further alternative embodiment, the above-referenced liquid dispensing apparatus with energy-saving baffle may be supplied with a source of water that is either a pressurized outside water source or a water bottle. An instaboil dispensing mode may be selectively enabled. In this mode, water in the hot tank may be heated to a near-boil for dispensing directly therefrom. Further heating of the hot tank may be stopped during instaboil dispensing, based on feedback from a temperature sensor, such as a thermister or thermocouple, located in a baffle region of the cold tank.

In still another alternative embodiment, dispensing of hot or cold liquids may be enabled in a first dispensing mode, all dispensing may be prevented in a second dispensing mode, dispensing of hot liquids may be prevented in a third dispensing mode, and visual displays of each of the selected dispensing modes may be provided.

BRIEF DESCRIPTION OF THE DRAWINGS

The novel features which are characteristic of the invention are set forth in the appended claims. The invention itself, however, together with further objects and attendant advantages thereof, can be better understood by reference to the following description taken in connection with the accompanying drawings, in which:

The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PREFERRED EMBODIMENTS

Figure 1:
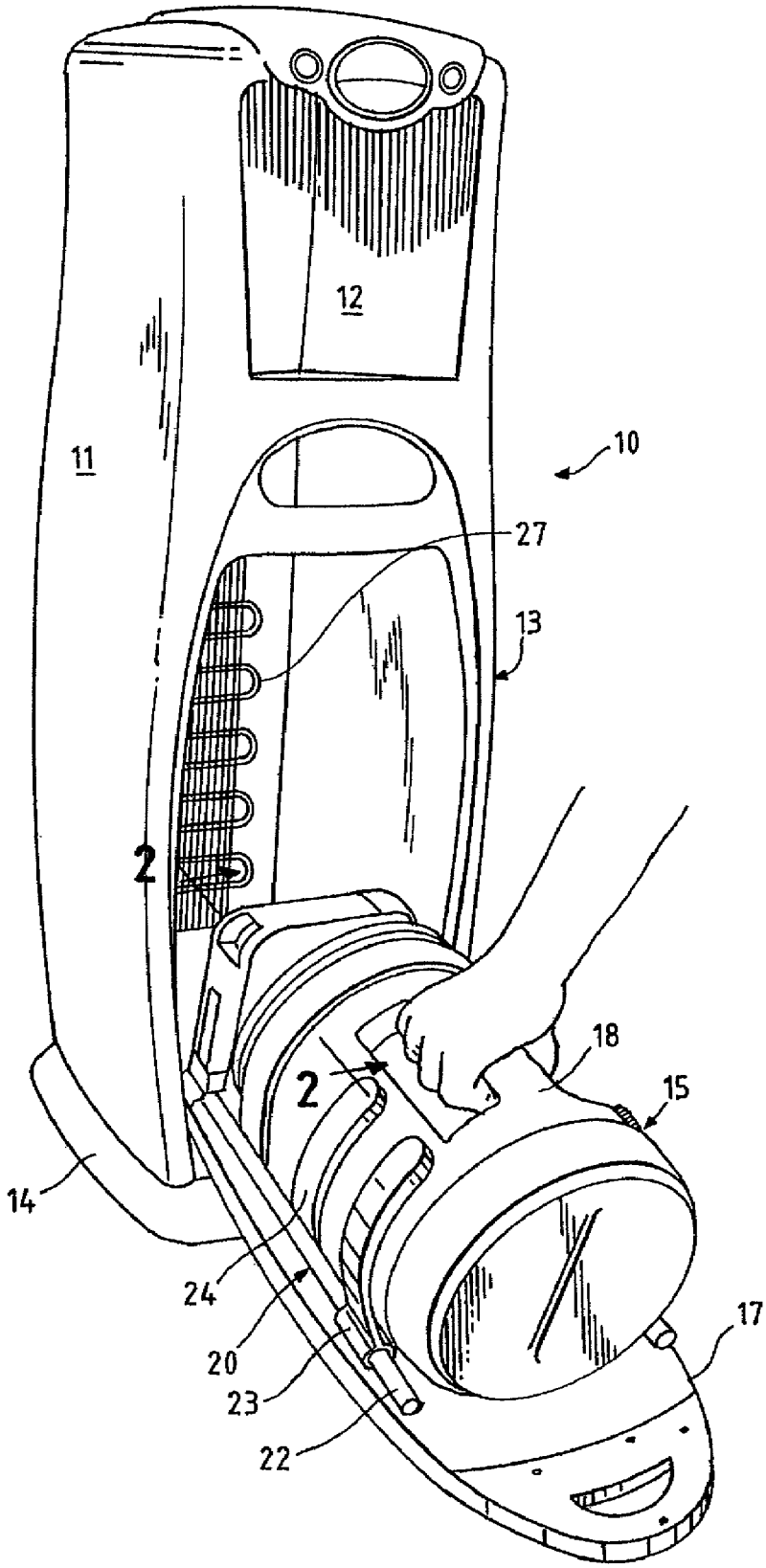
FIG. 1 is a front and side perspective view of a bottom load water cooler according to one preferred embodiment of the present invention, shown during loading of the water bottle.

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Referring first to FIGS. 1, 3 and 5-8, in a preferred embodiment of the present invention, a bottom load water cooler, generally designed by reference numeral 10, is shown. Bottom load water cooler 10 may include upstanding frame 11, an alcove 12 for liquid dispensing, a lower compartment 13, and a base 14. Lower compartment 13 may be opened such as by opening pivoting door 17 to accommodate the entry and exit of a water bottle 15, such as a 5-gallon water bottle. Condenser coils 27 may be located behind the engaged water bottle. Bottle 15 may include graspable handle 18.

A cradle 20 may include structural members 22, such as bent metal tubes, attached to door 17 via retaining members or flange 23, such as a cylindrical metal flange 23. Clasps 24 may be attached to flange 23. Metal struts (spacers) 19 may be used to secure the cradle to the door. Once the water bottle has been secured to cradle 20, the door may be pivoted upward and closed in the direction of the arrows. The door and cradle should be made of sufficient rigidity and strength to support the water bottle weight. The pivot point for the door may be located at an end portion of the cradle, and may rest (directly or indirectly) on the base and transfer the load/weight to the base during door closure, as further explained below.

The pivoting point for the door/cradle is preferably located at an end portion of cradle 20, and may lie adjacent and/or on base 14 and transfers the load/weight to the base. To use the bottom load cooler of the present invention, a user may roll or carry a bottle containing liquid such as water to a front end of the open door/cradle from a storage area, place the bottle upright, tip over the bottle toward the door/cradle, and push the bottle into the direction of the bottom of the door/cradle. The bottle may be permitted to glide smoothly onto the cradle and engage the dispensing interface device, described below.

A variety of retaining devices, such as flexible rubber, plastic or metal clasps (shown) and/or a bungee cord (not shown) may be used if desired to secure the bottle's bottom area (opposite the neck) to the cradle, while the bottle's neck area has been secured to a filling device such as a hollow probe, as discussed below.

It will be appreciated that because the lifting point for door closure is preferably located at the distal end of the door/cradle opposite the bottle neck, a user may only need to lift about half of the bottle weight to close the bottle/cradle due to the leverage advantage.

Safety Stop

Figure 10:
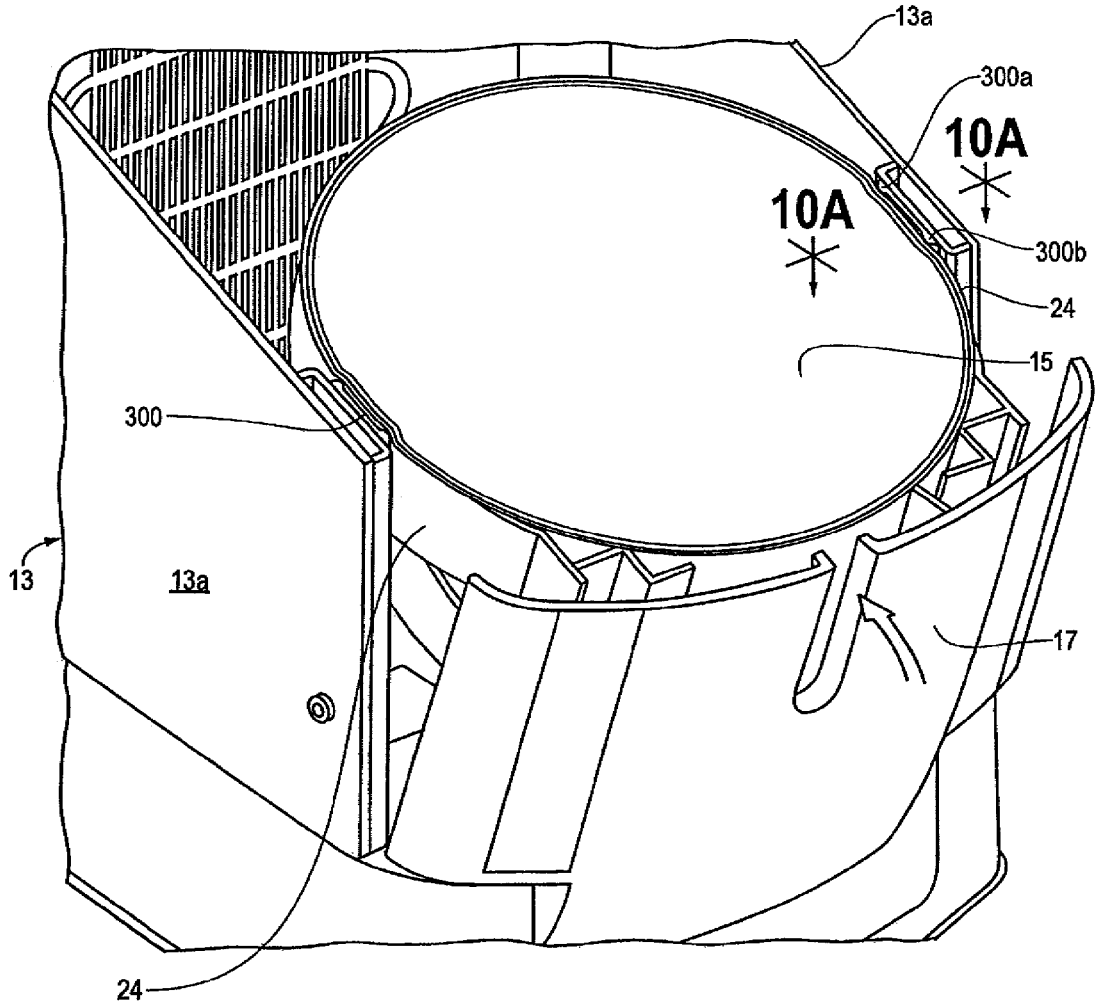
FIG. 10 is a top and side perspective view of a horizontal cross-section of a preferred embodiment of a bottom load water cooler (lower portion) holding a water bottle with the door slightly open.
Figure 10A:
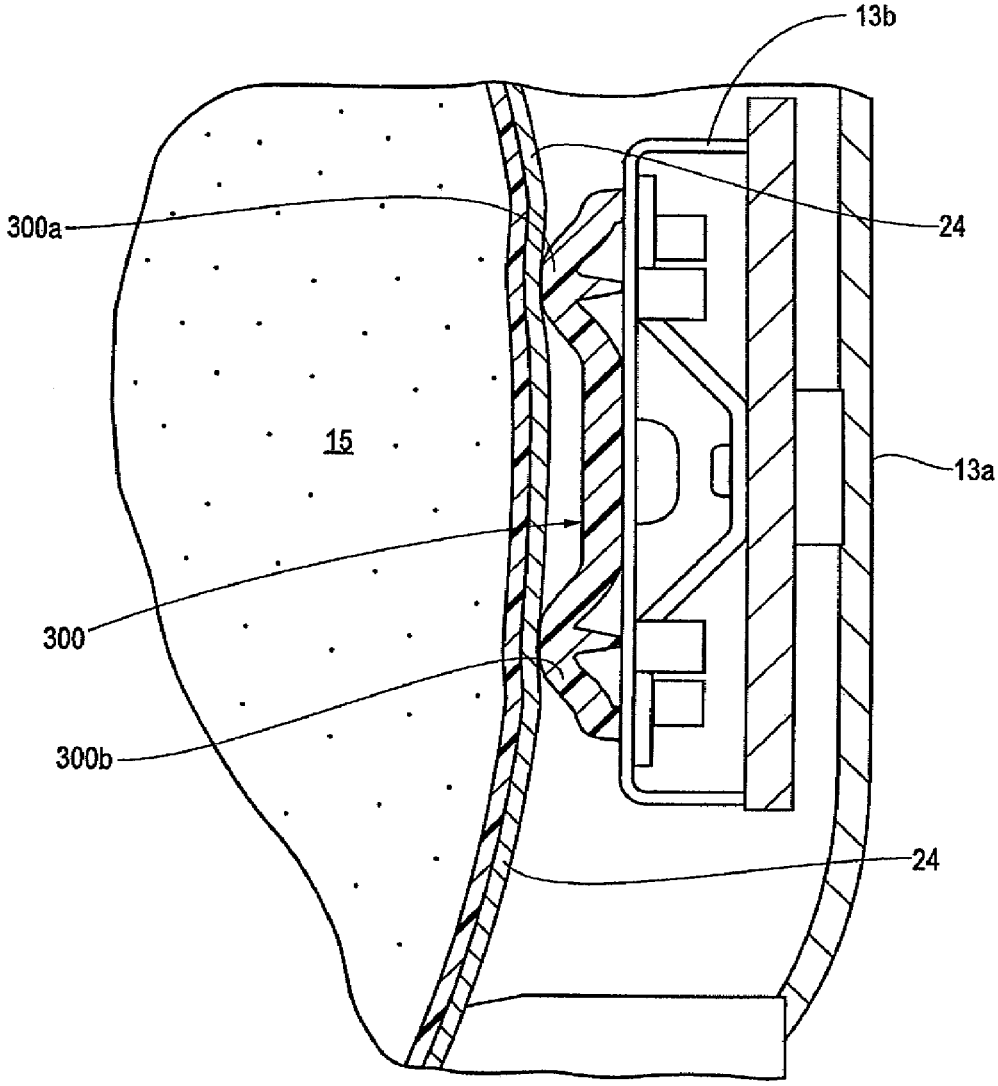
FIG. 10A is an enlarged, partial sectional view of the safety stop mechanism and surrounding area of FIG. 10.
Figure 11:
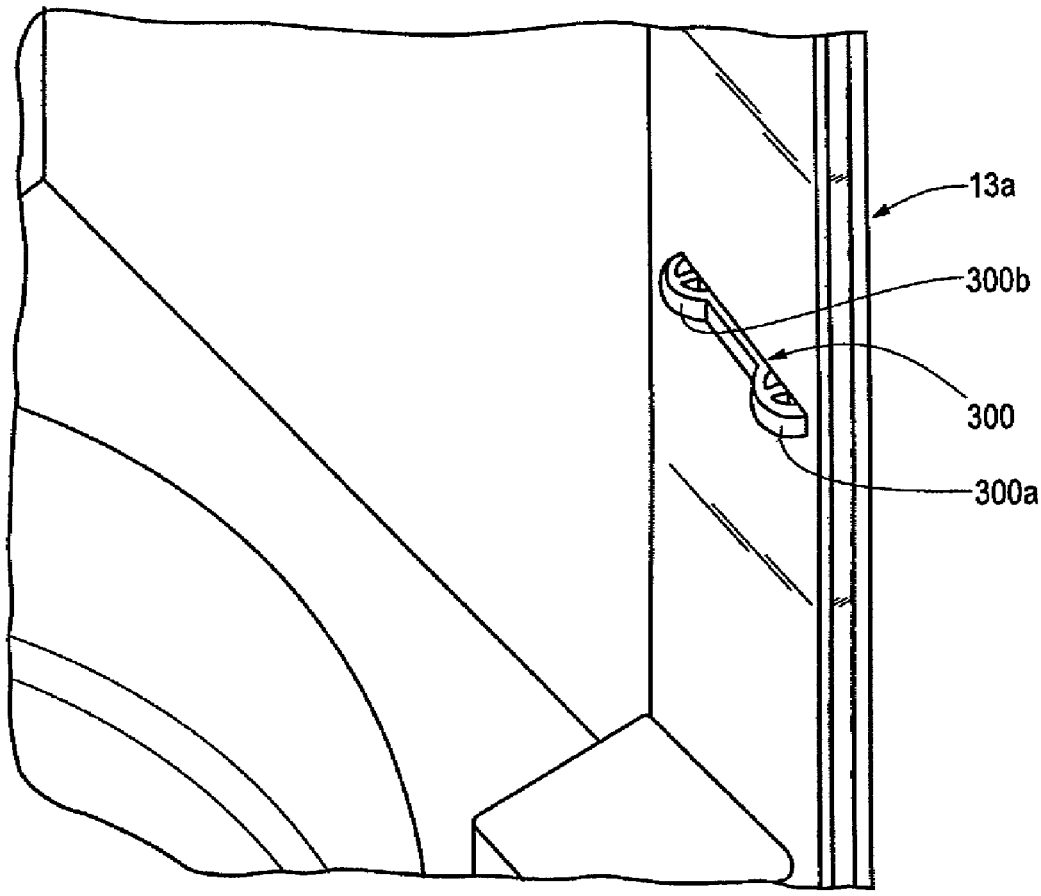
FIG. 11 is an enlarged perspective view of the safety stop mechanism shown in FIG. 10.

Referring now to FIGS. 10-11, a preferred embodiment of the bottom load water cooler of the present invention incorporates a retaining or safety-stop mechanism 300 to prevent the water cooler door from accidentally falling open when there is a bottle in place, which may inadvertently cause injury and/or spillage. Clasps (bottle retaining members) 24 may be used to hold the bottle in place when opening or closing the door. Bottle retaining members 24 may be deformed and move outwardly against stop mechanism 300, causing members 24 to catch at two "speed bump" locations 300*a*, 300*b*, for example, located on the wall 13*a* of lower compartment 13 (Stop 300 may be rigidly attached to 13*b* which, in turn, is attached to wall 13*a* (FIG. 10A)). When door 17 is retained in a half-open position by safety-stop mechanism 300 in this manner, for example, the mechanism can be configured such that the force required to open the door past speed bumps 300*a*, 300*b*, is substantially greater than any outward opening force which may be exerted on the door due to the weight of the bottle; thus the door will not accidentally fall to the floor without a substantial extra force applied upon it. This extra force required to open the door may be designed to be in the range of 8-12 pounds for example (for a 5 gallon 40-pound water bottle, for example), so that a senior citizen can easily spring the door open, while ensuring that the door will not accidentally open.

Adjustable Bottle Interface

Figure 6:
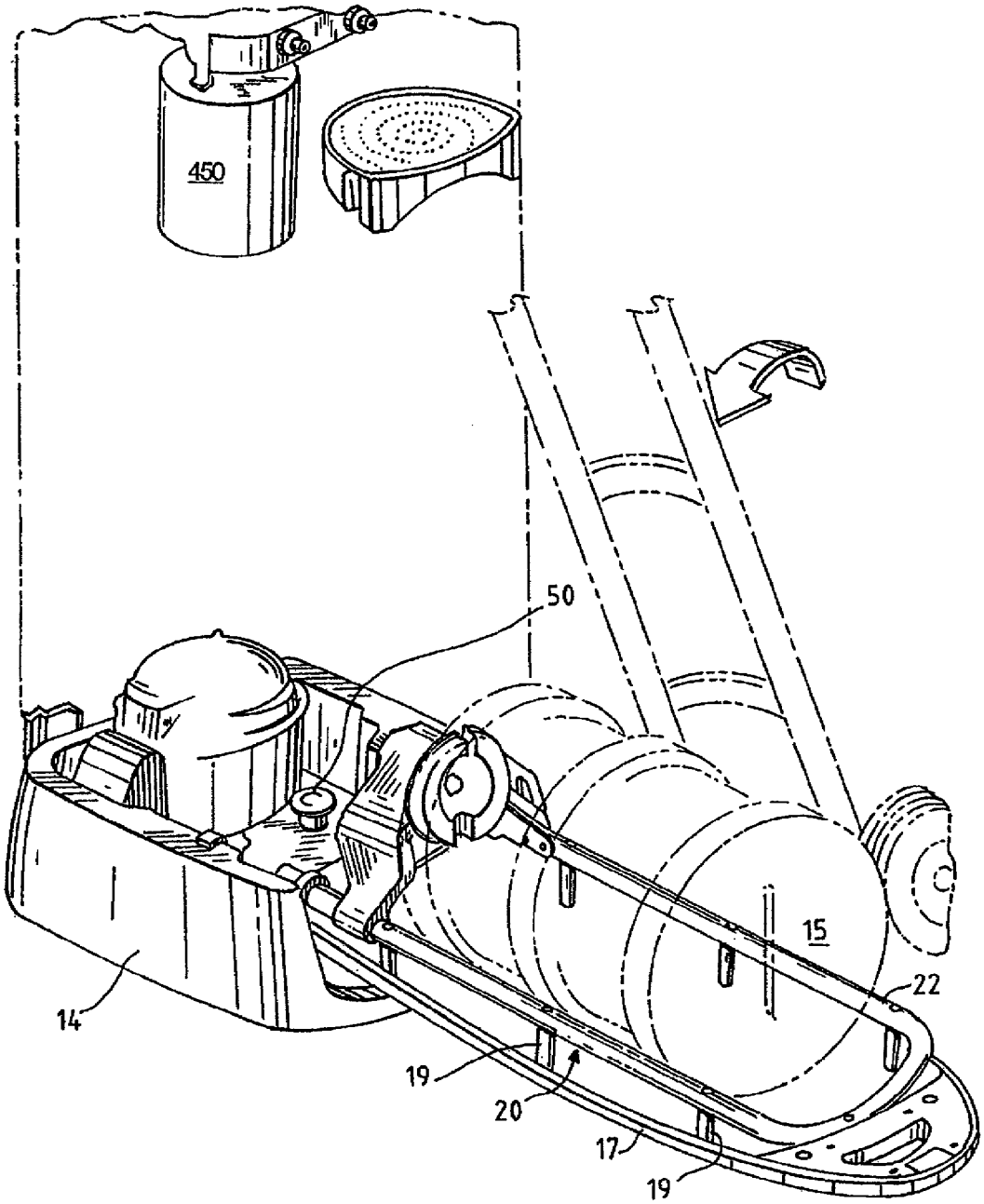
FIG. 6 is a partial side and front perspective view of the bottom load water cooler of FIG. 1, shown during the bottle loading process.
Figure 7:
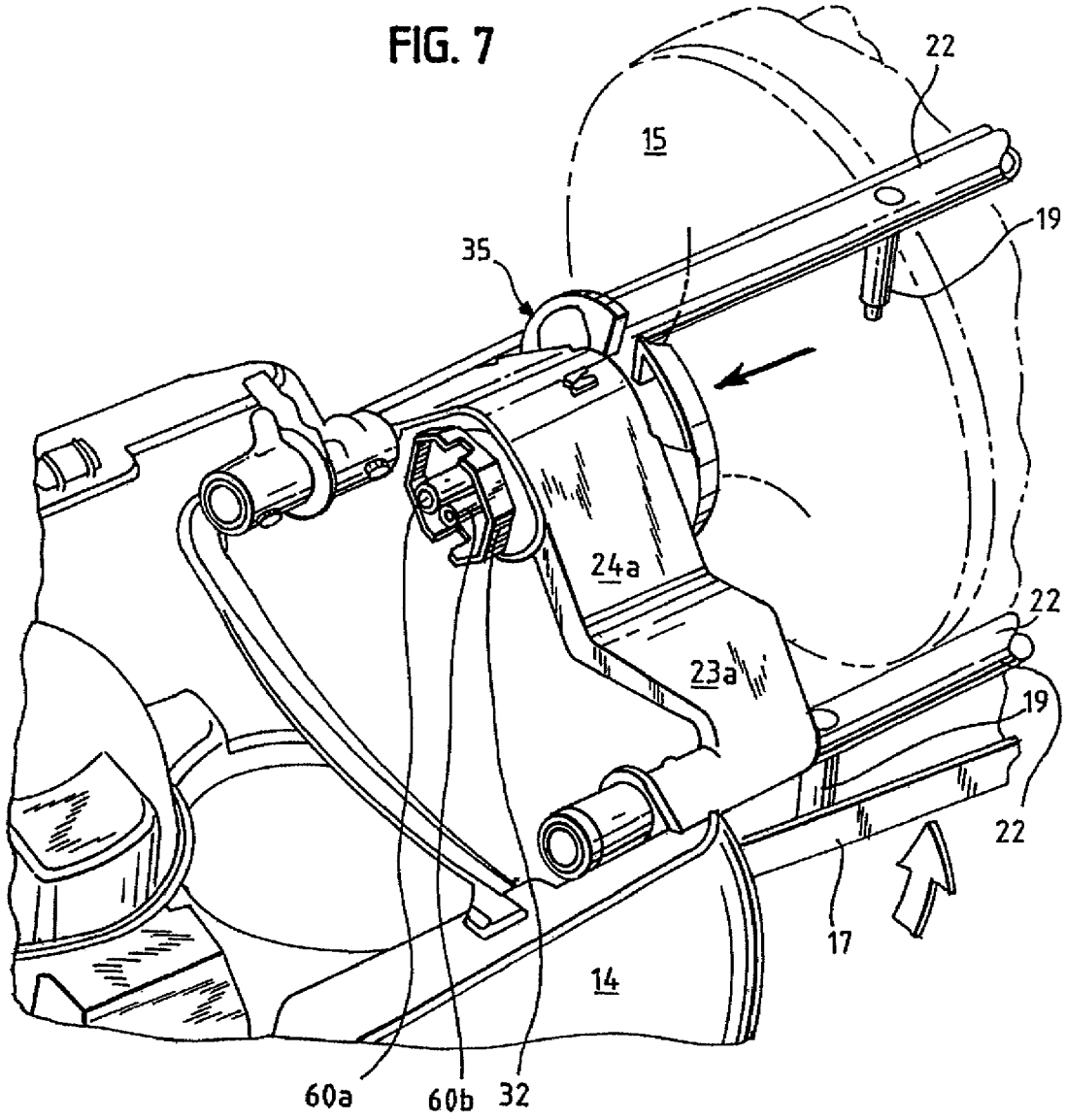
FIG. 7 is a partial, enlarged, side perspective view of FIG. 6.
Figure 8:
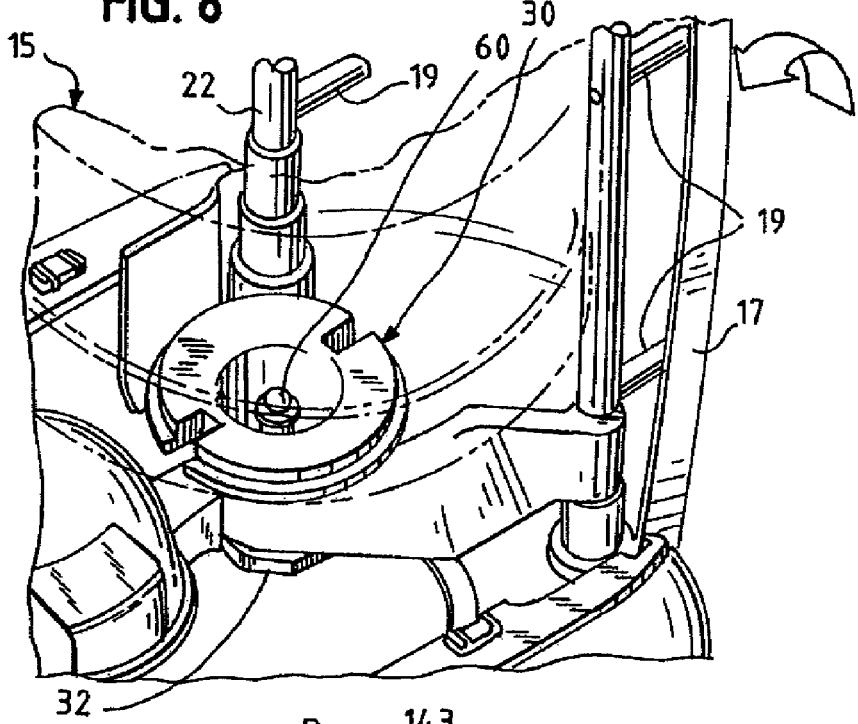
FIG. 8 is a view similar to FIG. 7, showing the water bottle in a fully raised condition, engaged and in fluid communication with the water cooler.
Figure 12:
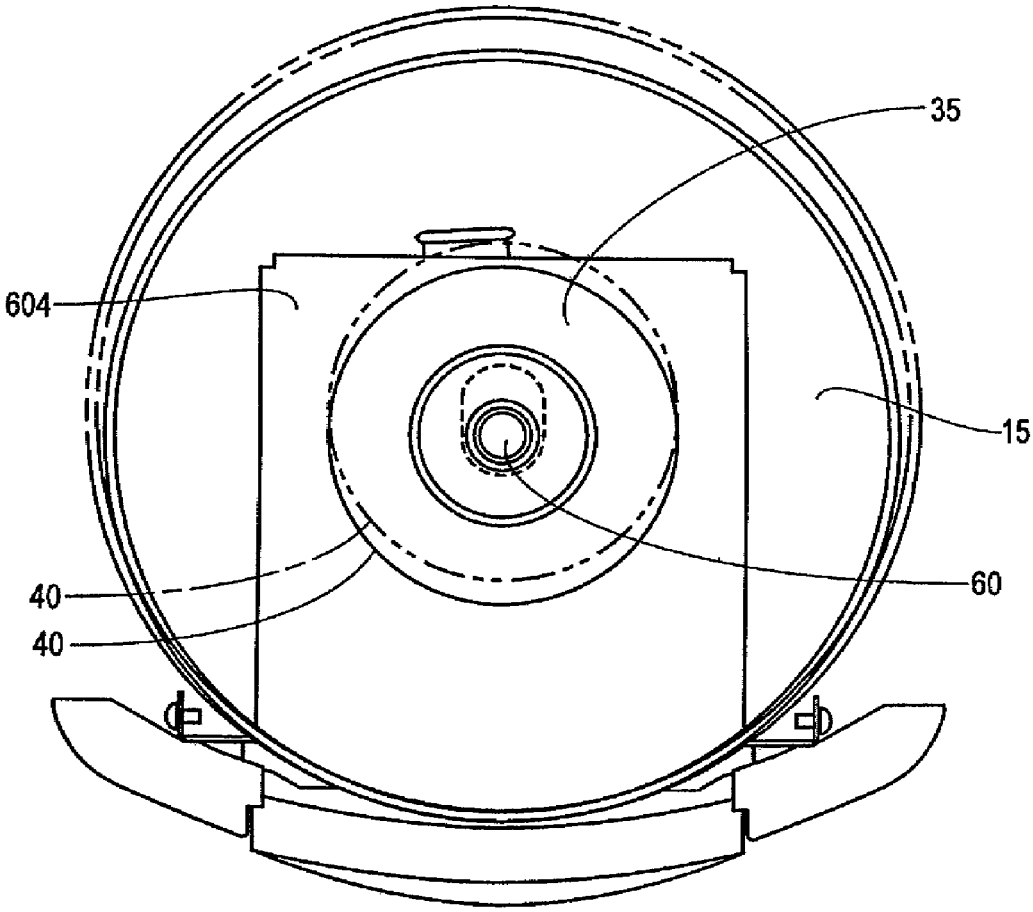
FIG. 12 is a top view a water bottle, probe and door according to an alternate body of the invention.

Now referring to FIGS. 6-8 and 12, in an alternative preferred embodiment, water cooler 10 of the present invention may be provided with an adjustable bottle interface feature, enabling the water cooler to accommodate dimensional variations of water bottles in the market. For this purpose, base 604 includes bottle guard 35 (FIG. 7) designed to carry the weight of the inverted water bottle. Bottle guard 35 is thus the interface with the bottle neck 40. Referring to FIG. 6, bottle 15 rests on rails 22 during installation; different bottle sizes force the water bottle to interface with probe 60 at different positions. In this embodiment, bottle guard 35 moves within a spring-loaded or spring-loss slot, enabling the bottle interface location to shift up and down, as shown in FIG. 12, to accommodate various bottle dimensions.

Figure 5:
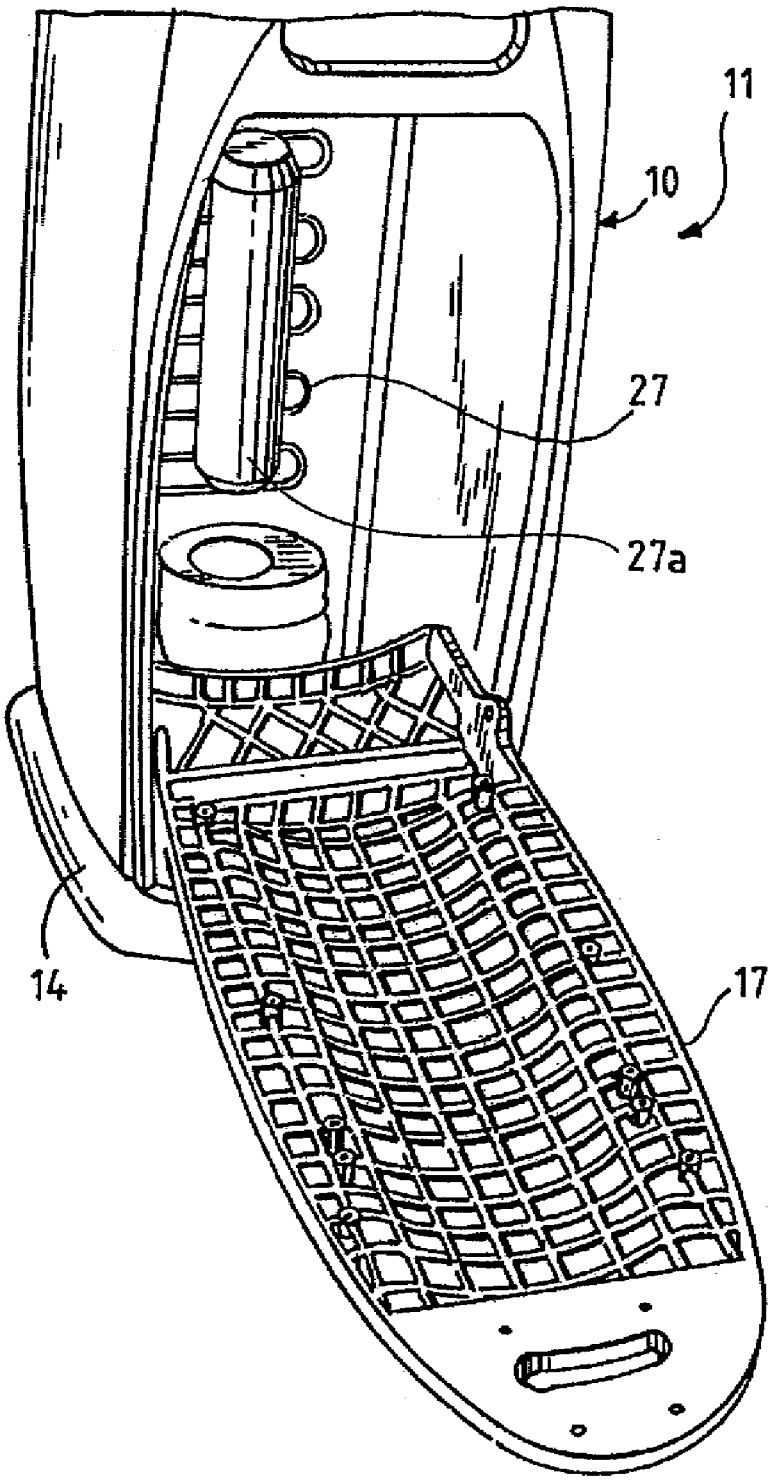
FIG. 5 is a partial (lower) front and side perspective view of the bottom load water cooler shown in FIGS. 1 and 3.
Figure 9:
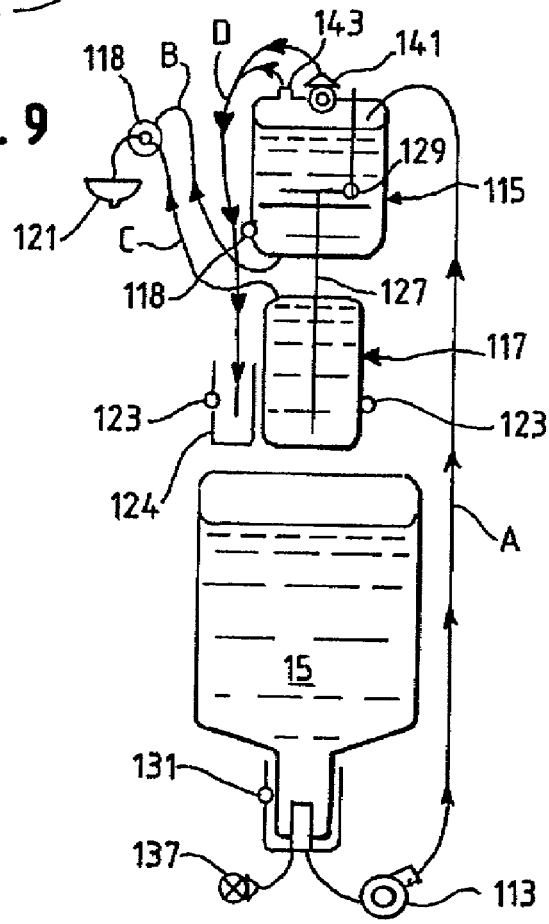
FIG. 9 is a schematic view showing one flow diagram useful with a preferred embodiment bottom loader water cooler of the present invention.

Referring to FIG. 5, a compressor 27*a* for the POU unit may be provided. A conventional drip tray (not shown) may be provided below dispenser spout 121 (FIG. 9).

Adjustable Drip Tray

Figure 13:
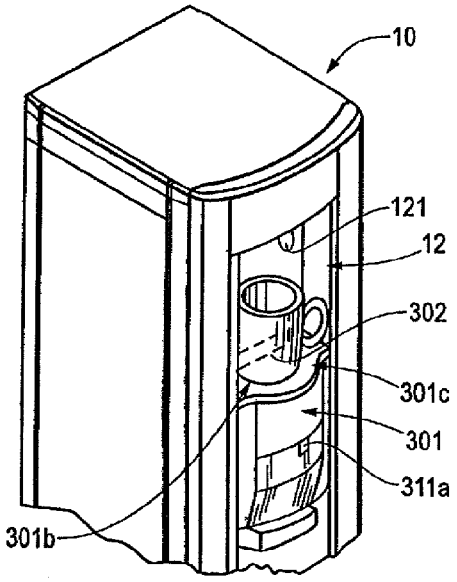
FIGS. 13 and 14 are a partial (upper) top and side perspective views of another alternative embodiment of the bottom load water cooler of the present invention.
Figure 14:
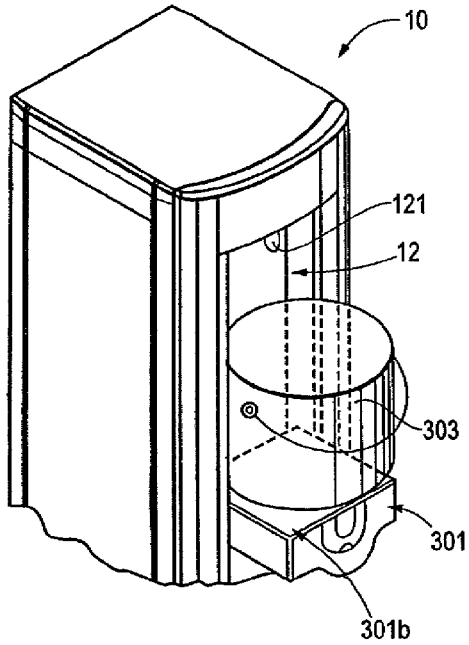

Referring now to FIGS. 13-17, an alternative embodiment is shown which does not use a conventional drip tray. Here, spout 121 within alcove 12 may be provided to dispense liquid into a container resting on adjustable drip tray assembly 301. Adjustable drip tray assembly 301 includes pivotable platform 301*b* and drip tray 305. When platform 301*b* is in the folded-up or retracted position shown in FIG. 13, retracted surface 301*c* is provided (see FIG. 15 as well) and enables accommodation of a conventional-sized vessel, for example. When platform 301*b* is upwardly pivoted to an extended position as shown in FIG. 14, extended surface 301*d* is provided, enabling accommodation of larger-size vessels such as pot 303.

Figure 15:
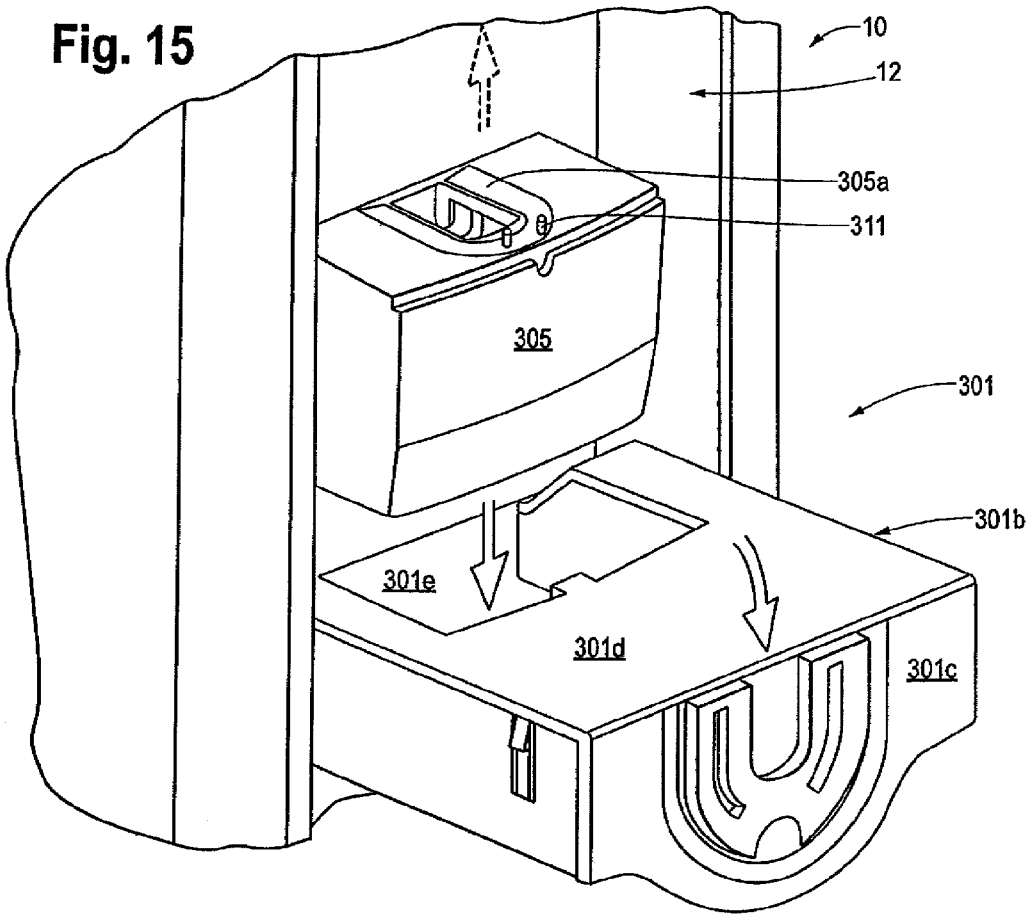
FIG. 15 is a partial, enlarged top and side perspective view of FIG. 14.

Referring to FIGS. 13 and 15, drip tray 305 may normally rest within compartment 301*e* of platform 301*b*, so that it is secured in place within, or partially within, fold-down tray 301, to ensure that the drip tray is not lost or moved during transportation. In this embodiment, for example, drip tray 305 may only be removed while the fold tray is in extended position 301*b*.

Referring to FIG. 15, when drip tray 305 is full, platform 301*b* may be placed in its extended position, and drip tray 305 may be lifted up, removed from platform 301*b*, and emptied.

Figure 16:
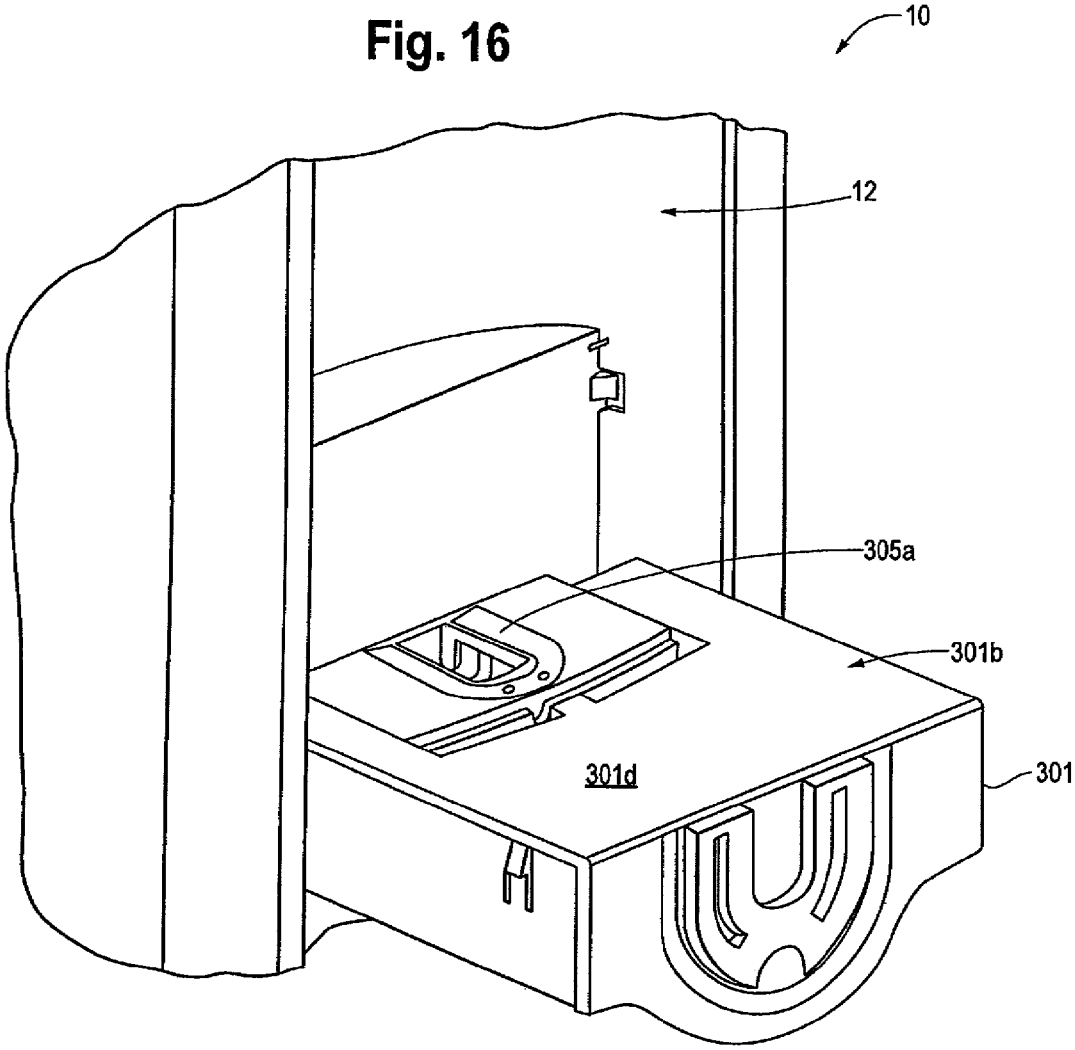
FIG. 16 is a partial, enlarged top and side perspective view of FIG. 14.
Figure 17:
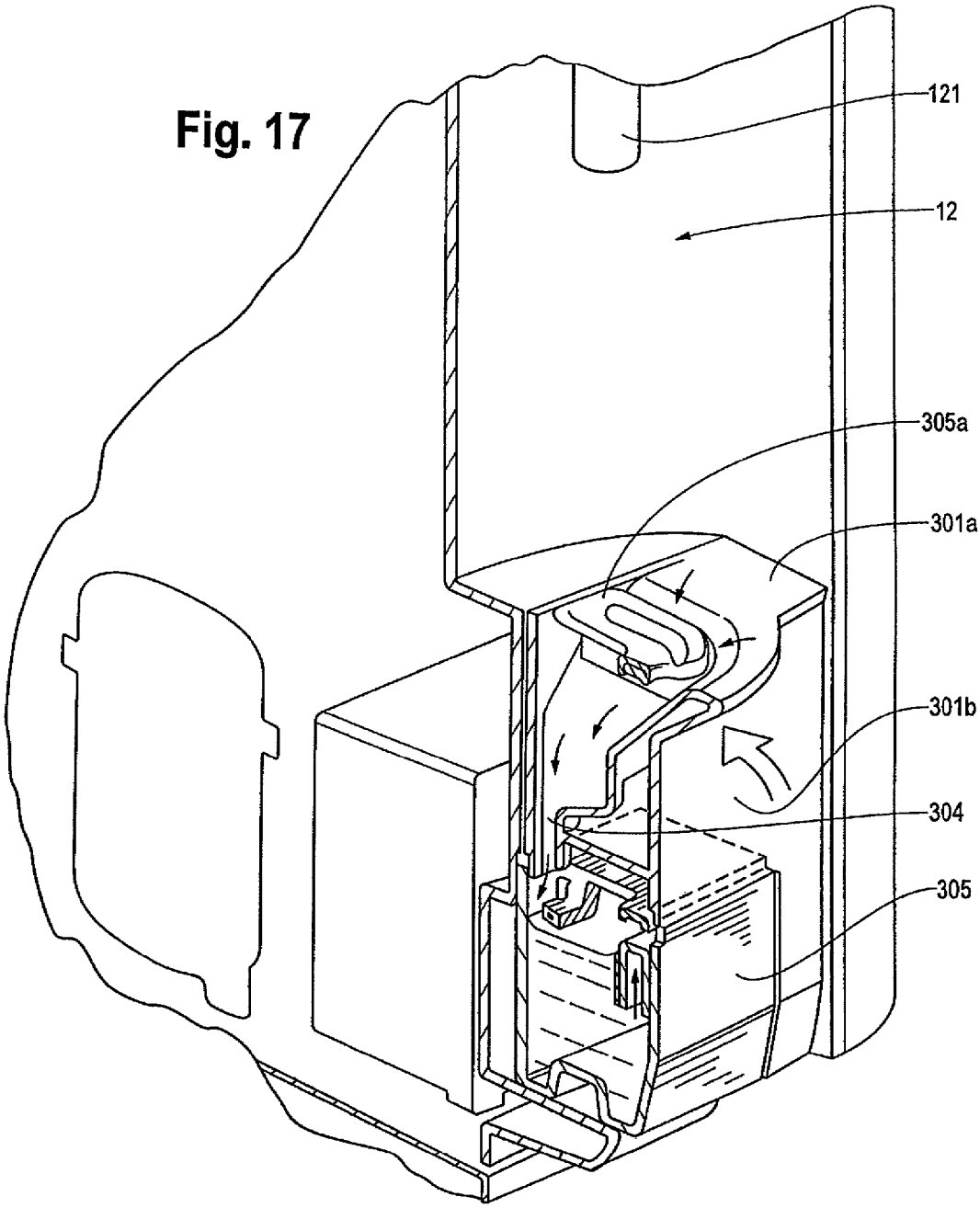
FIG. 17 is a cross-section of a partial enlarged rear and side perspective view of FIG. 14.

Referring to FIG. 16, tray 301*b* may include a drip tray grille 305*a* that provides an additional flat surface for a large vessel to sit on. Any leaked water may be funneled by drip tray grille 305*a* directly to drip tray 305, below. For this purpose, and referring now to FIG. 17, showing platform 301*b* in the folded-up or retracted position, a channel 304 may be provided between drip tray grille 305*a* and drip tray 305 to guide any spilled liquid into drip tray 305.

A water-full indicator 311 (FIG. 15) may be employed, and may be viewed through a see-through window 311*a*, for example, when the fold-down tray 301 is in the retracted position 301*a* (FIG. 13), and from the larger vessel platform (FIG. 15) when the fold-down tray is in the extended position 301*b*. Indicator 311 may be a bright red piece of plastic, for example, to provide a good visual cue to notify user that the drip tray should be emptied. Water full indicator 311 may be raised up by water buoyancy when drip tray 305 is full of water. A built-in air pocket may be provided for water full indicator 311. When the fold-down tray is in the retracted position 301*a* and drip tray 305 is full of water, the user can view indicator 311 from the notch/see-through window 311*a* of drip tray 305. When the fold-down tray is full of water in the extended position 301*b*, user can see the user can view the indicator 311 projecting from drip tray grille 305*a* as shown in FIG. 15.

Figure 2:
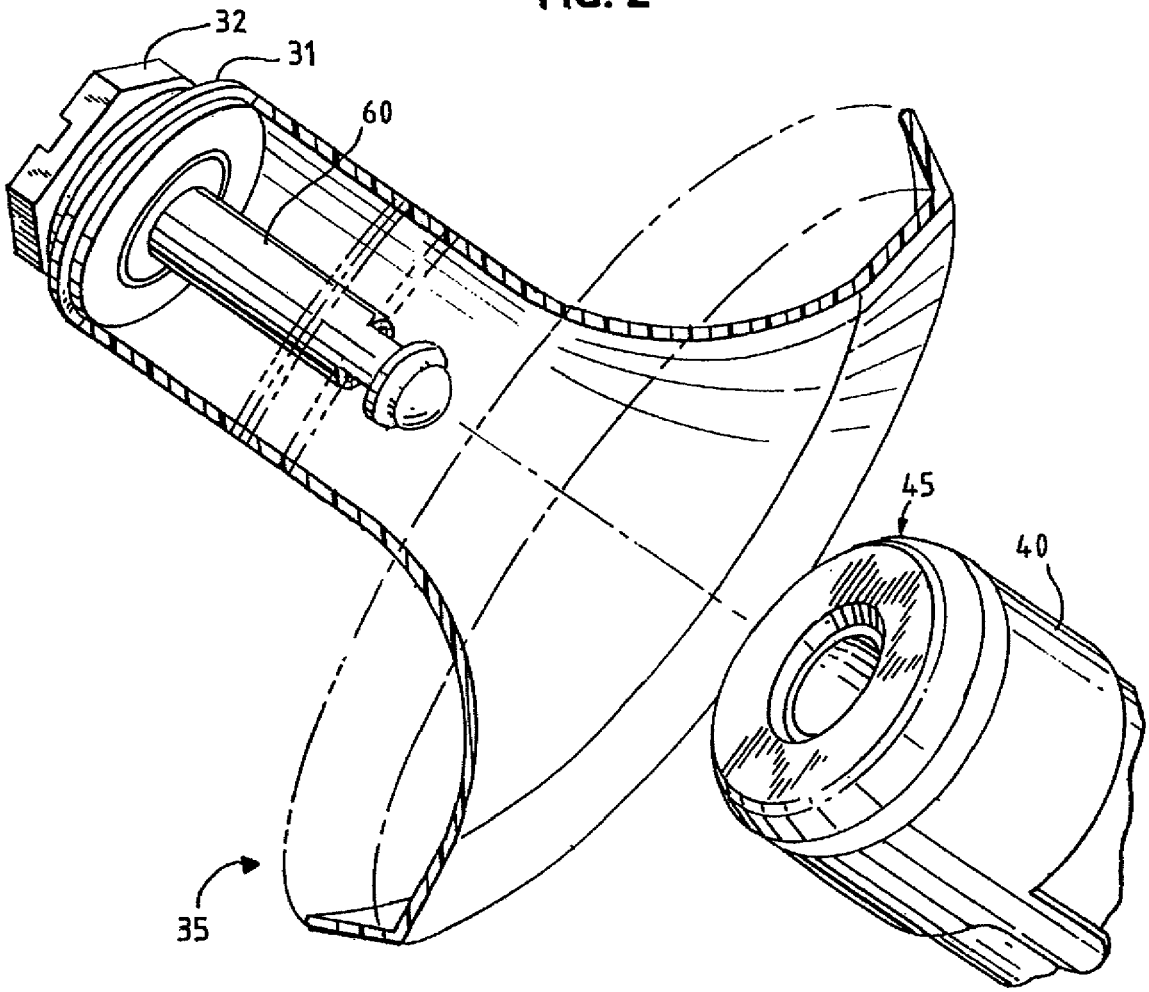
FIG. 2 is an enlarged, partial sectional and partial perspective view of the skirt for partially supporting the water bottle and the probe for penetrating and being in fluid communication with the water bottle, of the preferred embodiment of the present invention.
Figure 3:
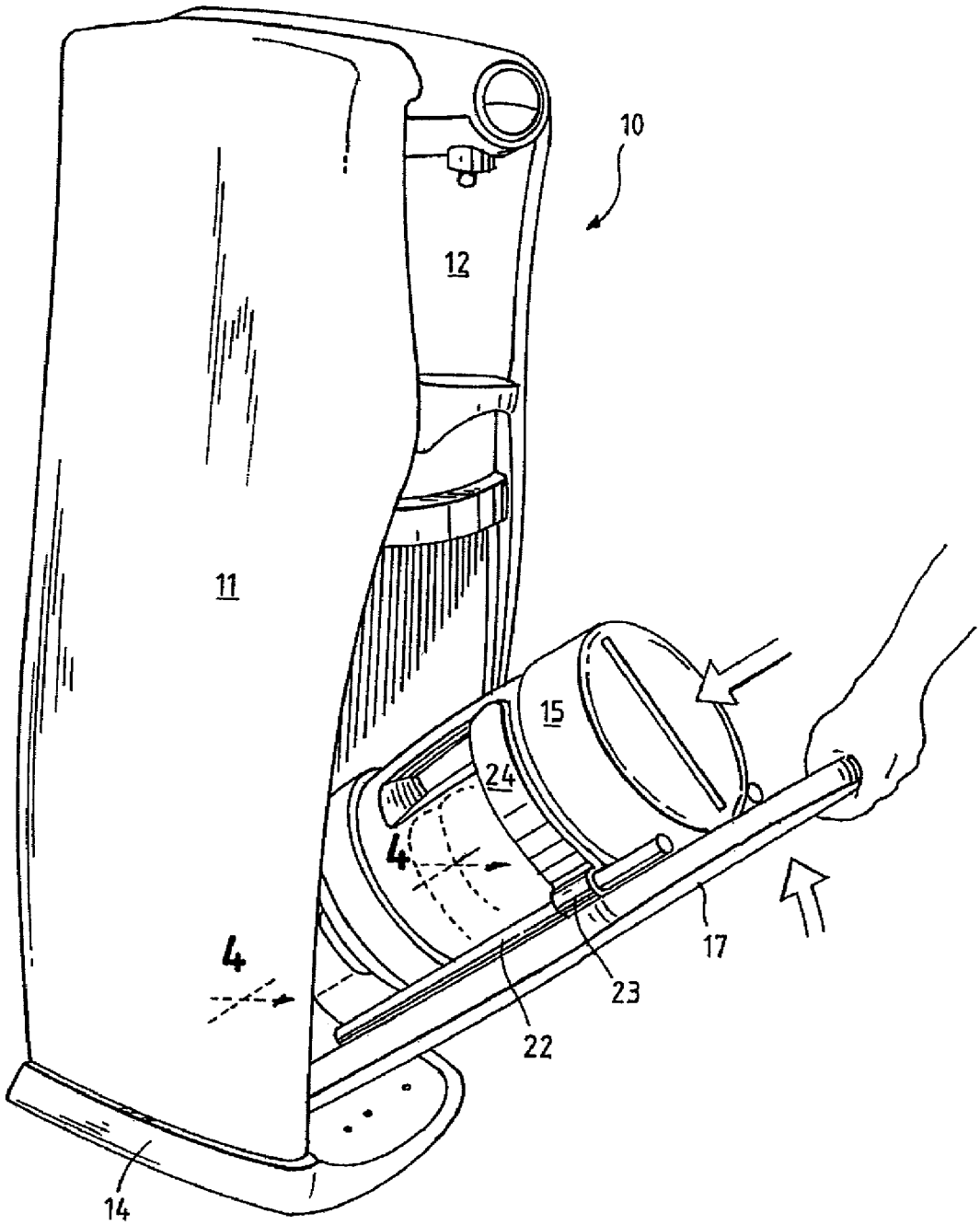
FIG. 3 is a side perspective view of the bottom load water cooler shown in FIG. 1.
Figure 4:
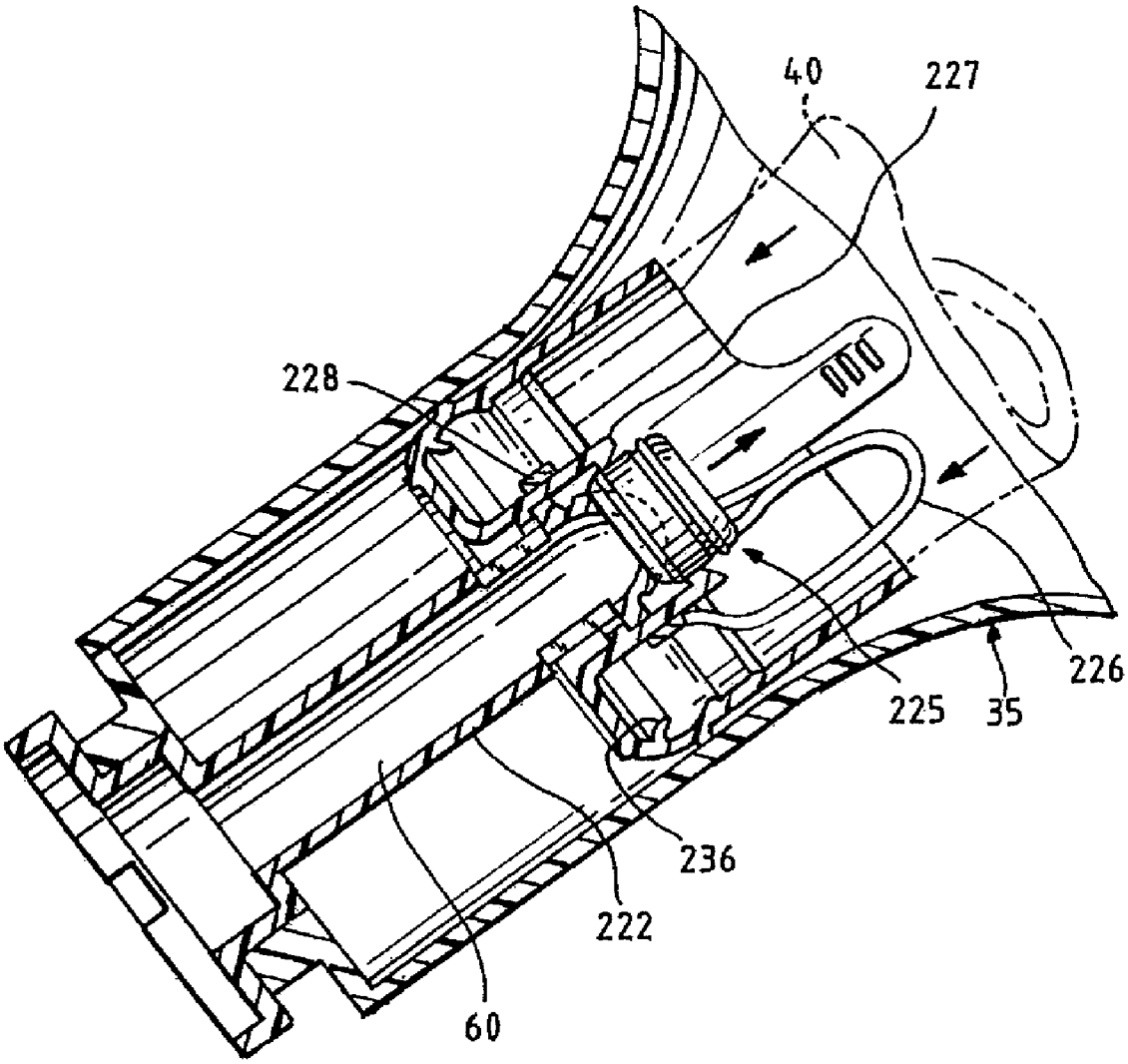
FIG. 4 is a sectional view showing the neck of the water bottle engagement to the probe of the water cooler.

Referring now to FIGS. 2 and 4, a preferred dispensing interface device is described. A water cooler base 50 (see FIG. 6) may be secured to an upstanding feedstock or probe 60. Probe 60 may have a probe base 32 and threaded proximal portion 31 for connection to an upper reservoir 450 (see FIG. 6). A skirt or bottle guard 35 may surround the probe (see also FIGS. 6-8), designed to carry the weight of the bottle via bottle neck 40 when the cradle is pivoted to an upright condition such that probe 60 is placed in fluid communication with bottle cap 45.

A conventional bottle cap may be employed. However, preferably, a bottle cap is employed such as shown in FIG. 2 of the Bottle Cap Invention, for example. In this embodiment, a cap plug 225, having an attached tether 226 and ring 28, is also provided. Ring 228 may be placed over the outer surface of inner wall 227. Cap plug 225 may then be inserted within inner wall 227 of bottle cap 40. A rib on the outer surface of cap plug 225 may be designed to provide a liquid-tight seal with an engaging lip on inner wall 227. During dispensing, liquid may be permitted to flow from the liquid source down through the bottle neck and bottle cap 40, down through cap plug 225 (a pinhole, not shown, may be provided in the closed top for this purpose), through hollow probe 222. When the liquid source (e.g., water bottle) is empty, and is removed from the probe, bottle cap 40 with cap plug 225 intact may be removed as an integral piece from the probe, for example.

A conventional probe may be used to engage the water bottle, such as disclosed in U.S. Pat. No. 5,289,854 to Baker et al., while bottle caps of the type disclosed in U.S. Pat. No. 5,232,125 to Adams and U.S. Pat. No. 5,957,316 to Hidding et al., may be employed. The disclosures of these three patents are hereby incorporated by referenced herein in their entirety. However, a probe providing separate air and water flow paths may be preferred, such as disclosed in the Liquid Dispensing Invention.

Bottle Leak Stop Mechanism

Figure 18:
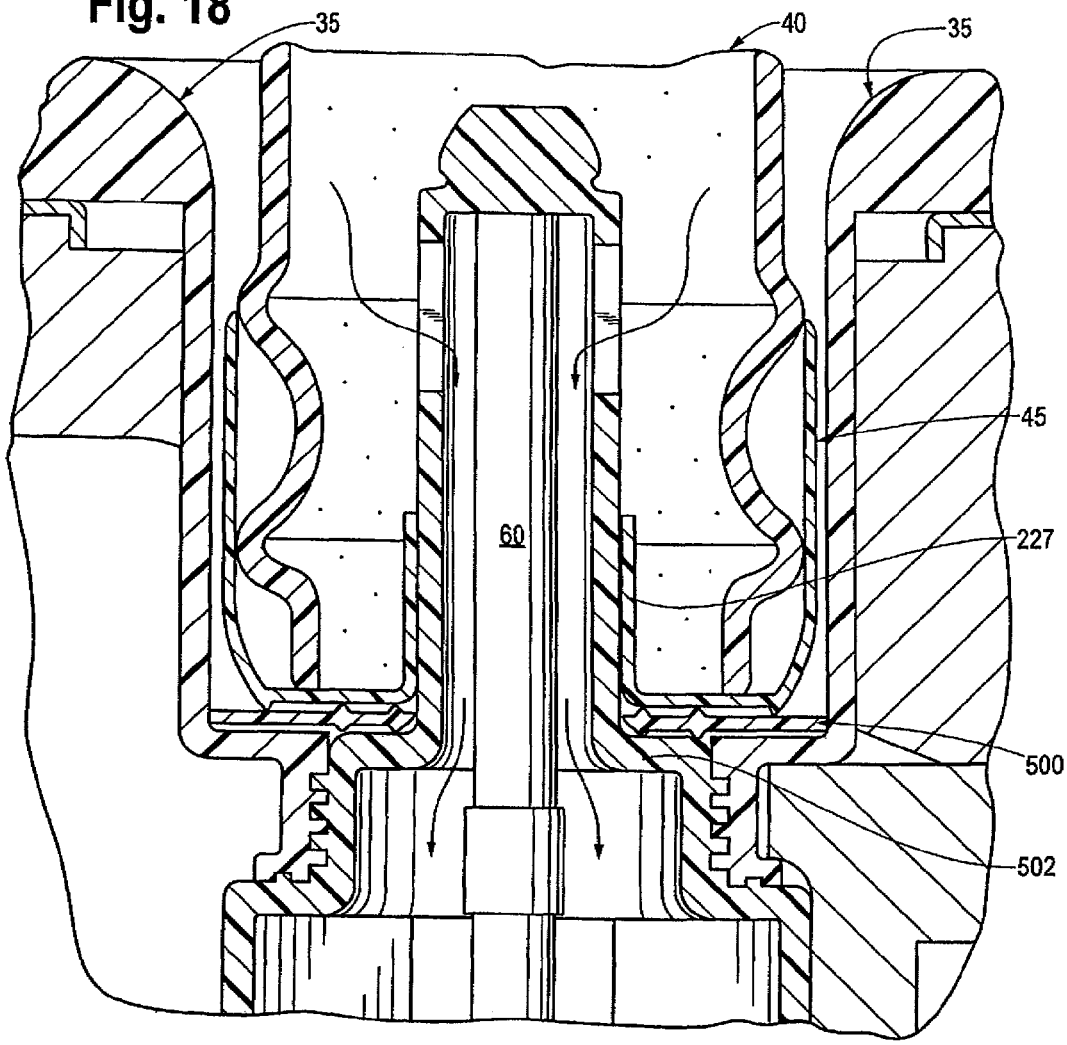
FIG. 18 an enlarged, partial sectional and partial perspective view of the skirt and bottle cap engaged with a probe according to another embodiment of the invention.
Figure 19:
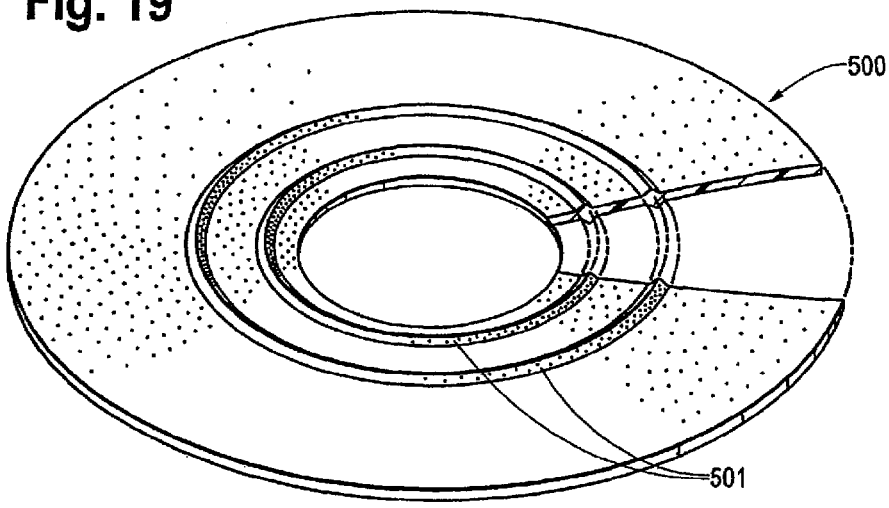
FIG. 19 is an enlarged portion of a leak stop mechanism embodiment shown FIG. 18.

Currently in the marketplace, water in a bottle may be allowed to flow out from the bottle during times when no dispensing should be occurring. This may happen because the probe and cap cannot maintain an effective seal, due to a variety of reasons such as a defective part (e.g., the water bottle may have a crack or pinhole in it or the probes or caps may be defective, either due to manufacturing defects or due to large pressure/temperature changes). In an effort to circumvent such problems, and referring now to FIGS. 18-19, in an alternative embodiment of the invention, a leak stop mechanism 500 may be utilized as shown to create additional seals 501 between probe 60 and cap inner wall 227, preventing water leaks. Leak stop mechanism 500 may be located between cap 40 and bottle guide 502. Leak stop mechanism 500 may be made of an elastomer such as silicone rubber, for example, and is designed to create additional seals between probe 60 and the inner wall of cap 40 to prevent water leaks. Shard or "knife-edge" seals 501 are preferably provided on both sides of leak stopper 500. The bottle weight pushing down on the small surface area of the elastomeric knife-edge seals 501 has been found to provide tight sealing and prevent water leaks. As shown in this embodiment, there is a knife-edge 501 of elastomer that will be deformed by the applied force of the bottle, and it will seal against the rigid plastic portions, cap 45 and probe 60. The knife-edge may occur on the plastic portion as well (cap 45 and probe 60), which will dig into elastomer mechanism 500 and create a knife-edge seal. (If both materials are rigid, such as hard plastic to hard plastic, the surface finish and tolerance control will be critical. In the case disclosed here, elastomer sealing against plastic, tolerances are not as important.)

Referring now to FIG. 9, one preferred liquid flow path for the bottom load water cooler of the present invention is shown. In this embodiment, cold tank 115 and hot tank 117 are positioned above water bottle 15. In order to fill and prime the tanks, water may be caused to flow along conduit A in the direction of the arrows from bottle 15, under pressure from water pump 113, into cold tank 115. Air flowing from the atmosphere through breathing check valve 137, preferably positioned close to the water bottle, may flow into bottle 15, avoiding air-lock and allowing continued dispensing. A vent solenoid valve 141 may be positioned at the top of cold tank 115, normally open, for switching the system open and closed, to render the cold tank an open system when necessary. Near valve 141, an emergency-safety valve 143 may be employed to release the pressure inside the system in case the vent solenoid valve malfunctions. Cold tank temperature sensor 119 and hot tank temperature sensor 123 may be used to monitor and/or maintain temperatures in the tanks. Water sensor 128 may be used along with emergency reservoir 124 to send water along conduit D from the cold water tank to prevent overflows. 3-way solenoid 118 communicates along the flow path with spout 121, so that cold water may be provided from conduit B while hot water may be provided from conduit C. Baffle 127 may be provided within the tanks. Instaboil sensor 129 may be located adjacent the baffle and within cold tank 115. Bottle sensor 131 may be used to sense bottle installation, triggering the start-up procedure.

In practice, and still referring to FIG. 9, as an example, a user may depress a water dispensing button, allowing a PCB (not shown) to transmit a signal to close vent solenoid valve 141 to render the system closed. 3-way solenoid valve 118 opens conduit B or C and water pump 113 starts pumping water up into cold tank 115, and dispenses water from spout 121. When the user releases the water dispensing button, the PCB transmits a signal to open vent solenoid valve 141 and render the system an open system. 3-way solenoid valve is closed to stop water dispensing, and water pump 113 ceases pumping. Using the instaboil feature (e.g., an electric dispensing pot available from Zojirushi, Japan), the hot tank can boil water when desired by the user; excessive water/vapor generated by the boiling function may be bled from the system using the vent solenoid valve 141, emergency safety valve 143 and emergency reservoir 124.

Water Cooler Interior

Figure 20A:
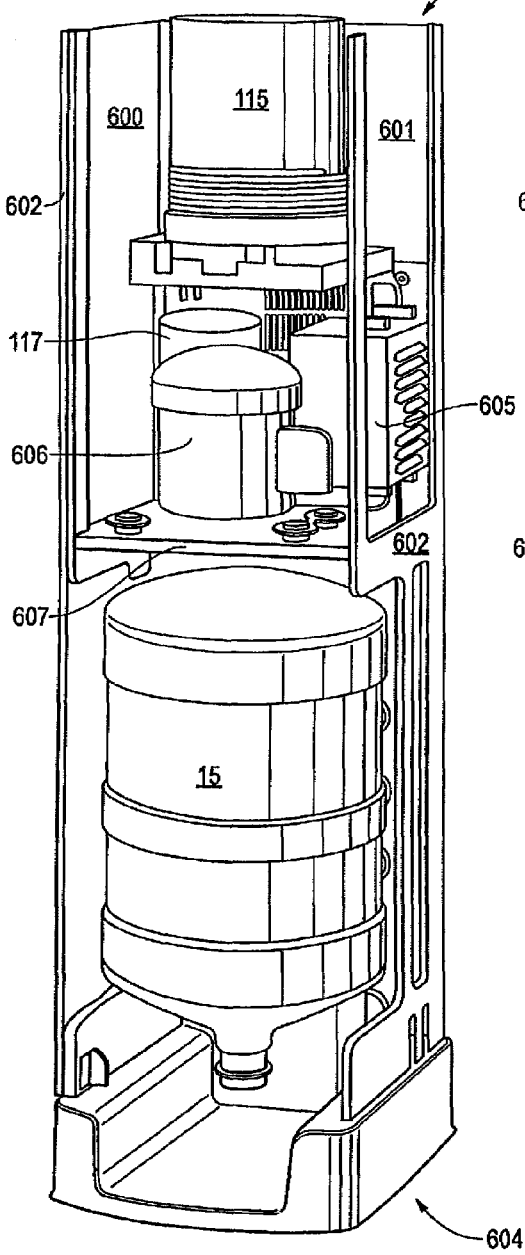
FIG. 20A is a front and side perspective of the interior structure of a bottom load water cooler according to a preferred embodiment of the invention.
Figure 20B:
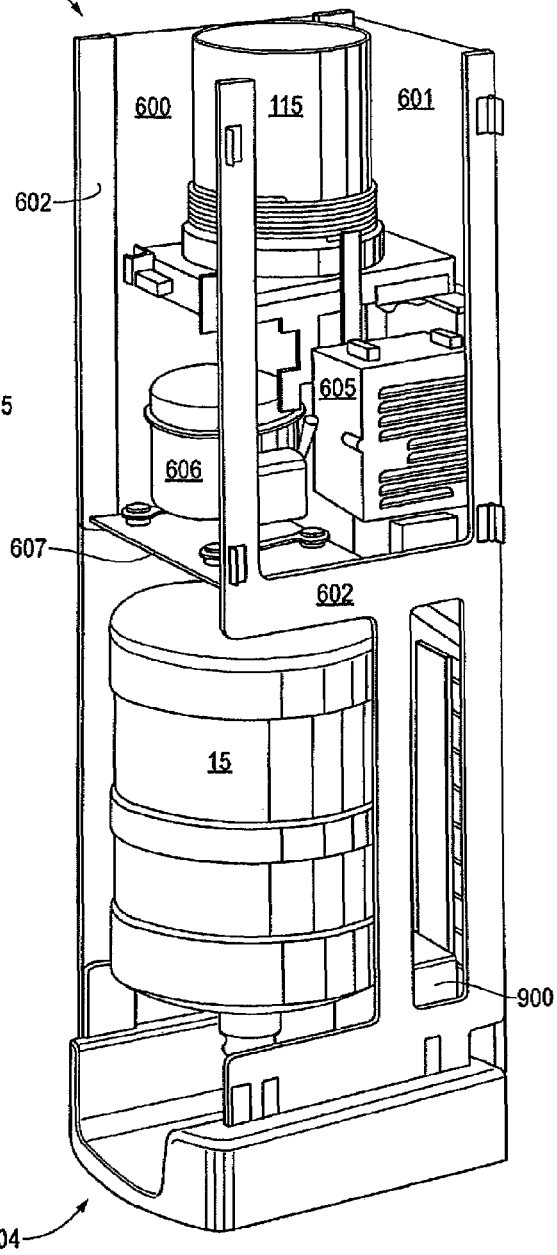
FIG. 20B is a side and front perspective of the interior structure of the bottom load water cooler shown in FIG. 20A.

Referring to FIGS. 20A and 20B, the internal structure of one preferred embodiment of the bottom load water cooler 10 of the present invention is shown. Here, base 604 supports the entire structure. Base 604 supports SIP $O_3$ generator 900 which maybe located below and to the side of water bottle 15. Water bottle 15 may be located below center chassis 607. The upper half of the internal structure may be located above center chassis 607, and may include compressor 606, which may be situated between side frames 602. Hot tank 117 may be located behind the compressor, and the cold tank 115 may be located above the hot tank. PCB module 605 may be positioned adjacent to compressor 606. Panels such as side panel 600 and rear top panel 601 may be employed to enclose the internal structure.

Alternative Liquid Flow Paths and Instaboil Feature

Alternative embodiments with alternative water path schematics, useable with the above-described water cooler, or with other water coolers which are not necessarily "bottom load" coolers, will now be described. These alternative embodiments may use either a pressurized water supply from an outside source, or a bottle water supply.

Figure 21A:
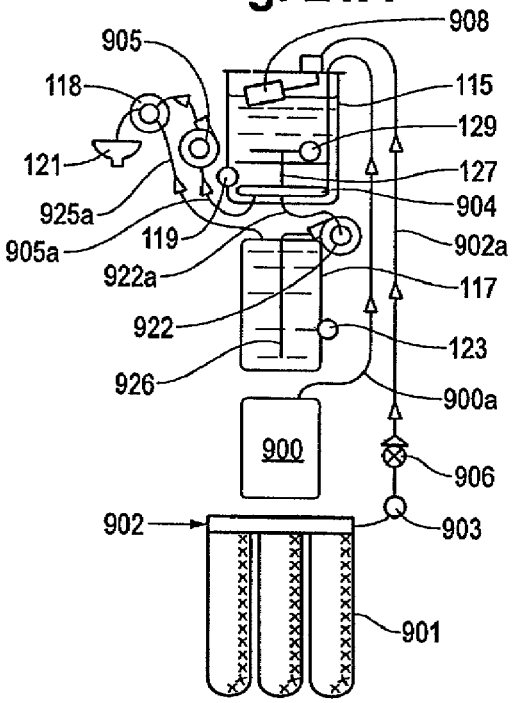
FIGS. 21A-21H are schematic views showing flow diagrams useful with various alternative embodiments for water coolers of the present invention.

Referring first to FIG. 21A, a water path schematic is shown for an embodiment of the invention in which water is supplied from an outside source, such as a city water supply 902, which may be first filtered using filter system 901. The water then moves along conduit 902*a*, and may flow through TDS module 903. TDS module 903 is a device to monitor the filtered water quality and a signal may be sent back to Horizon PCB for processing. City water may have a TDS (total dissolved solids) of about 100-200 ppm range. Some areas may be higher. Ideal drinking water is less than about 50 ppm. When the TDS module senses a TDS reading above the set value, it will trigger a warning for changing the filter module. After passing through the TDS module 903, the water may move past a solenoid valve 906 controlled by an electronic signal float switch 908 positioned within cold tank 115, which will indicate when the cold tank is full. A mechanical shut-off float switch may also be used, in which case solenoid valve 906 is the preliminary stop and mechanical shut-off may be used as the backup in case the solenoid valve fails. In this manner, spout 121 may be selectively supplied with water using 3-way valve 118; thus, cold water may be pumped, using water pump 905, from cold tank 115 along conduit 905*a*, while hot water may be supplied from hot tank 117 along conduit 925*a*. Hot tank 117 may be in fluid communication with cold tank 300 via conduit 922*a* which may be provided with a water pump 922.

Cold tank 115 may include a temperature sensor 119 (e.g., thermister) for maintaining the water within the cold tank within a predetermined temperature range. The cold tank may also be provided with an $O_3$ diffuser 904 for destroying waterborne pathogens, a baffle 127 for use in separating regions of different water temperature within the cold tank, and an NTC thermister 129 (see FIG. 22C, described below) which functions as an "instaboil" temperature sensor (the "instaboil" feature is further described below). Hot tank 117 may be provided with a temperature sensor (thermister) 123 to maintain the water in the hot tank within a predetermined temperature range. A SIP $O_3$ generator 900 may be provided to supply O3 gas along conduit 900*a* to O3 diffuser 904.

Figure 22:
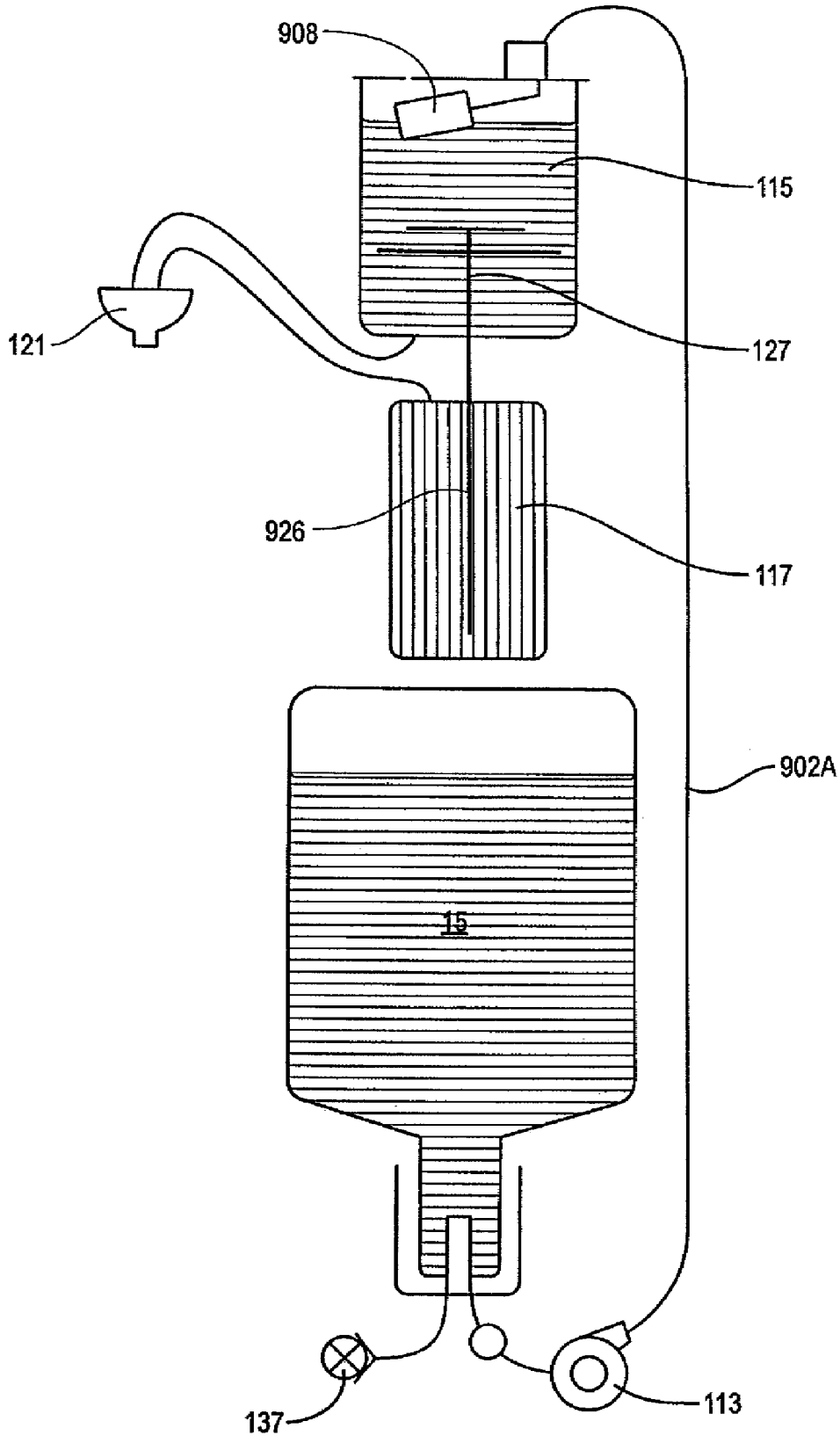
FIG. 22 is a schematic view showing a preferred embodiment useful for a bottom loader water cooler of the present invention.
Figure 22A:
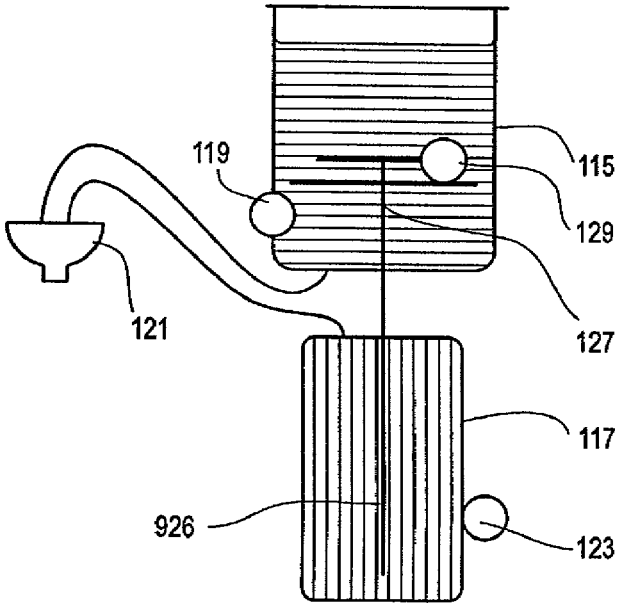
FIG. 22A is a schematic view useful for illustrating of the instaboil feature which is an alternative embodiment of the invention.
Figure 22B:
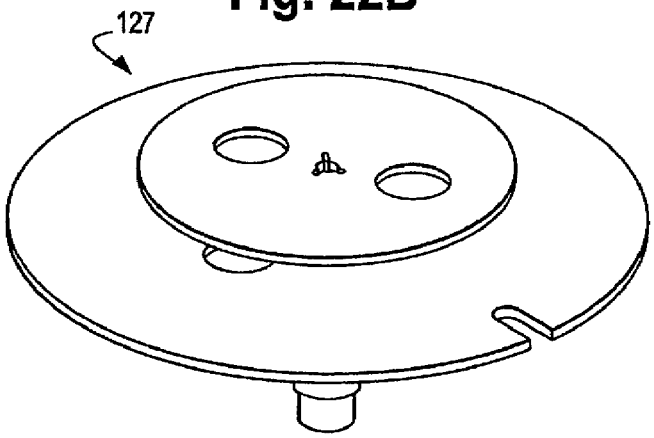
FIG. 22B is an enlarged perspective of the baffle of FIG. 22A.
Figure 22C:
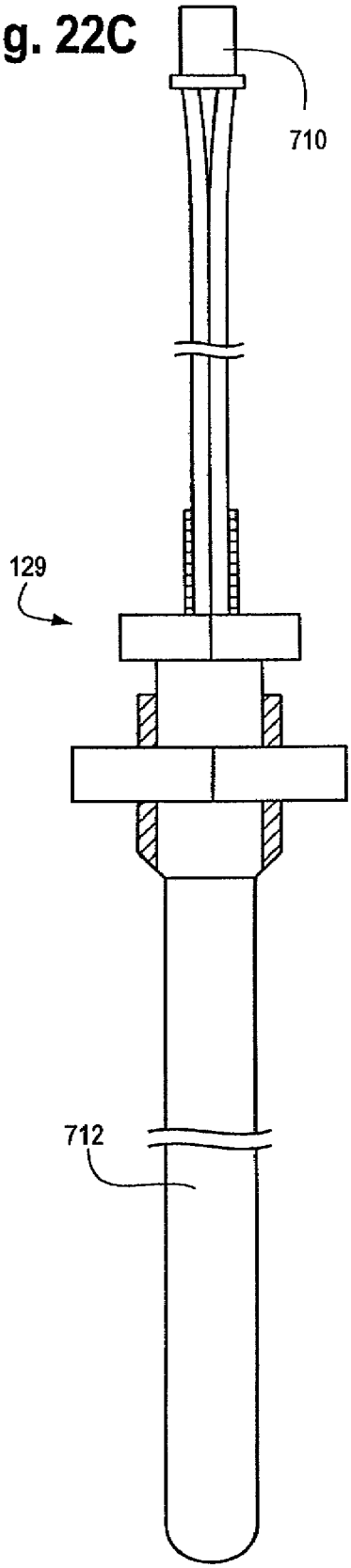
FIG. 22C is an enlarged perspective of a thermister useful with the instaboil feature of the invention.
Figure 23:
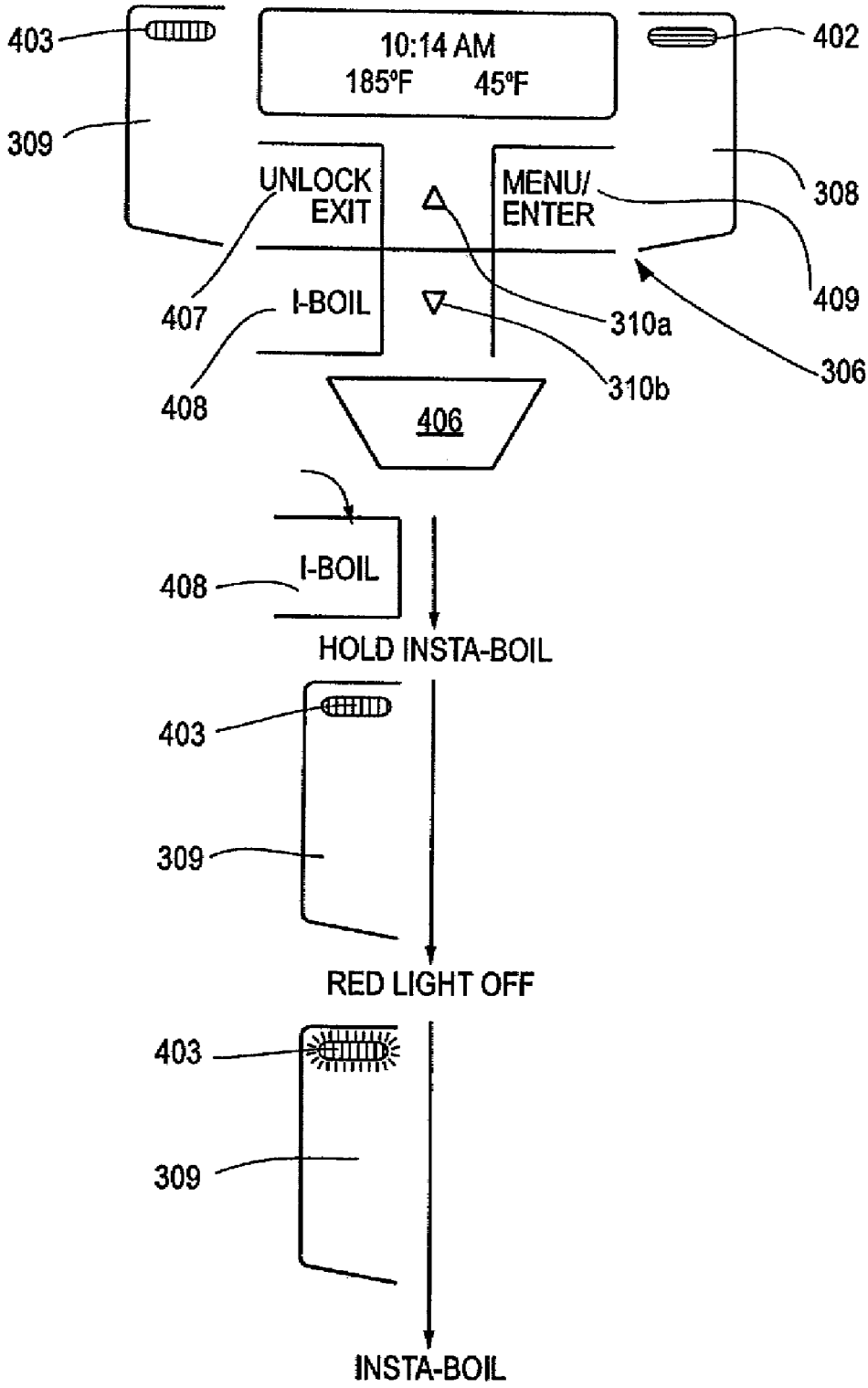
FIG. 23 is a schematic diagram illustrating visual features for one embodiment utilizing the instaboil feature of the present invention.

Referring to FIGS. 21A and 22-22B regarding the so-called "instaboil" feature (not an instantaneous boil, but rather a boil which may take about 3 minutes for example, in the disclosed embodiments), water in the hot tank may be brought to a near-boil using a heating band which is wrapped outside of the hot tank, for example. As the water almost reaches the boiling point within the hot tank, the generated steam/vapor expands and forces the additional volume of the hot water in the hot tank to flow towards the cold tank along tube 926, through pump 922, tubing 922*a* and baffle 127. The displaced water in the cold tank is pushed into unused volume inside the cold tank. As the boiling in the hot tank increases, and more of the hot tank water is boiling, sufficient volume expansion due to the generation of steam bubbles occurs and forces the hot water into the cold tank. Instaboil sensor 129 senses the sudden temperature change resulting from this influx of hot water/steam, and cuts off the power to the hot tank heater; residue heat will continuously bring the water to boiling or near-boiling, enabling dispensing in this condition at spout 121.

In designing the InstaBoil feature using relative low cost construction techniques for the commodity product of a water cooler, an important feature is sensing when the water begins to boil, and turning off the hot tank heating element at that time. In other words, a "Goldilocks" approach is preferred of not turning the heating element off too early (before boiling), and not too late (after substantial boiling has occurred). The traditional approach is to tighten the tolerance limits of the hot tank thermostat, but precision tolerance thermostats are not economical. Known coffee makers and other re-boil concepts turn off the heating element too early or too late, which is not economical and/or results in a reduction in performance. The problem is compounded when also trying to maintain cold water in a tank attached to the same water source as the boiling water.

The solution to the problem involved: (1) using the same, low-cost, wide-tolerance thermostat that had been used in the past; (2) limiting the boiling that takes place in the hot tank, while still achieving 100° C. heating before turning off the heating element; and (3) changing the design to provide a new approach to sensing boiling water based on volume change, and not temperature change.

A general theoretical understanding of the phenomenon is useful. Boiling water in the hot tank creates a large volume of water vapor, or steam, entrapped as bubbles in the hot tank water ("steam volume"). This steam volume, if not property controlled, can have a large impact on the cold tank water level (i.e., it can cause the water level to rise several inches). If this steam volume inside the hot tank can be properly controlled, its impact on the cold tank can be controlled, as well.

It was found that locating a low cost thermostat at various locations on the hot tank was not conducive to appropriate control over the steam volume. Steam volume did not start to form until the thermostat registered near 100° C., and then expanded rapidly as energy is continually added to the water. The steam volume effect in the hot tank can not be separated from the boiling water temperatures in the hot tank.

Surprisingly, it was experimentally determined that moving the thermostat location farther away from the heat, and near where the steam volume was moving to, the cold tank provides superior results. When the thermostat was moved to a location above the baffle in the cold tank, it was found that the water in the tubing leading from the hot tank to the cold tank stayed cold while the hot tank was heating up, and it was only when the steam volume started growing as the hot tank water was boiling (resulting in an easy-to-read, sharply spiking signal), that hotter water pushed up the tubing and gradually started to raise the thermostat temperature, signaling that the heating element should be turned off. Now, steam volume can be controlled while measuring a slowly-reacting change in water temperature at about room temperature. The rate of change provides an extremely reliable indicator of water boiling in the hot tank. Again, there was no technical reason that we could deduce that would have suggested that superior control over the boiling point in the hot tank could be accomplished by monitoring cold tank temperatures.

The result is that a new temperature measurement location provides the ability to measure a different physical event, i.e., the creation of vaporized water or steam bubbles in boiling water by sensing the expansion of volume they create by pushing the hot water out of the top of the hot tank, through the baffle tubing, and into the cold tank. The sharply rising temperature spikes which were experimentally found confirm a reliable indicator for when a near or full boiling condition is occurring in the hot tank.

Figure 25:
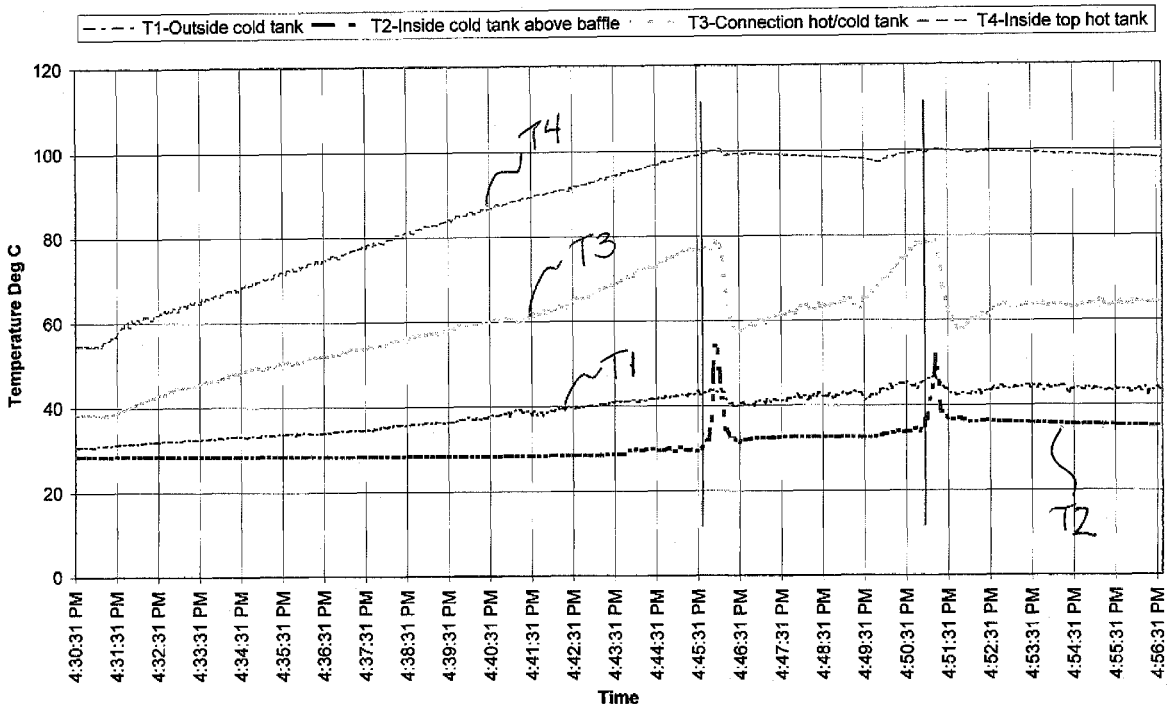
FIG. 25 is a chart showing temperature of hot tank over time.
Figure 26:
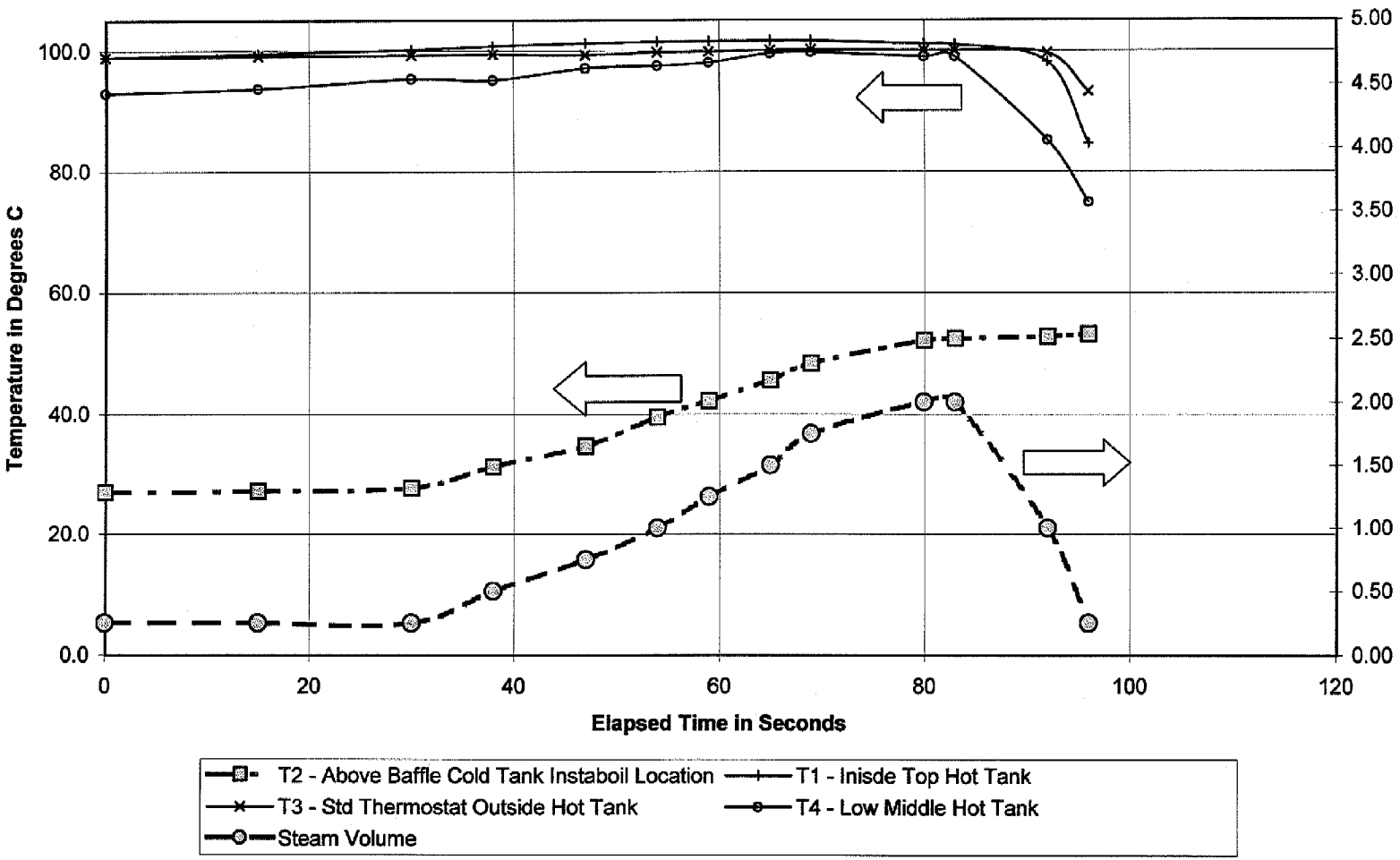
FIG. 26 is a chart showing temperature in hot tank over time as compared to steam volume in inches produced over time.

It was discovered that, optimally, instaboil sensor 129 should be located near baffle 127. Referring to FIG. 22B, baffle 127 may be of a type manufactured by Prosonic/IGO, a Malaysian manufacturer. (The baffle tends to decrease the required cooling and heating times, by appropriately controlling the flow of water between temperature regions within the cold tank.) The baffle region area within the cold tank provides a steady increasing temperature trend when the hot tank water heats up. There will be a temperature spike just before the boiling point. This phenomenon is further explicated in FIG. 25, a chart showing clear spikes in temperature when the sensor is located inside the cold tank above the baffle. FIG. 26 shows that the rising temperature in the hot tank correlates with the expanding steam volume in the cold tank. If the heat source is stopped (shown at about 55° C. here), the steam volume collapses rapidly. With the instaboil sensor in this optimal location, the water in the hot tank will steadily increase and will slowly approach 100° C. without surpassing it.

It may be that the instaboil sensor can be placed at alternative locations, such as the bottom of the hot tank, top of the hot tank, inside of the hot tank, inside and outside of the tube 922*a*, etc. However, these locations may not provide the appropriate temperature pattern enabling the Horizon PCB to determine when to cut off the heater without using expensive and sophisticated sensors and components; it is believed that this is the case because false temperature sensor indications may be given due to convection currents causing uncertain amounts of hot water to flow into the cold tank, and cold water flowing back into the hot tank. For these reasons, it currently appears that placing the instaboil sensor 129 in the baffle region of the cold tank provides the best performance.

More specifically, without an appropriately-located instaboil sensor such as in the region of baffle 127 within the cold tank, the accuracy of cutting the heat to the hot tank may be compromised for various reasons, as now explained. First, using hot tank temperature sensor thermister 123, instead of instaboil sensor 129, may cut off power too early or cut off power too late because it is less accurate. Using this thermister 123 only, part of the hot water may be pushed back by steam if the heater is cut off late but not too late. Seconds later, the steam gets cooled down and shrinks. The water in the cold tank starts to get sucked back to the hot tank and may get mixed with the boiling water. A potential result is that the water is not sufficiently hot, or all the hot water may be pushed back to the cold tank by the steam and create overflow, such that even colder water results in the hot tank.

Second, if the instaboil sensor 129 is in an inappropriate location there may not be a regular temperature pattern, and insufficiently hot water or overflow may occur. Lastly, if the instaboil sensor is not used and the water dispenser is set to a preset boiling temperature, the system may not be able to accommodate for altitude differences and may result in the same temperature or overflow issues. Typically, a thermostat change is needed in high altitude regions. With the currently disclosed system, a water cooler located in Denver, can automatically adjust and deliver almost boiling water in the range of about 200-203° F.

An exemplary heat band wattage range for the hot tank may be from 520 W-575 W (±10%), although different wattage ranges may be used. The hot tank size should not materially affect the instaboil feature, and 1.2 liter and 2.0 liter size hot tanks have been successfully used.

A small hot water pump may be used to push hot water out of the hot tank instead of sucking water out from it, enabling the unit to deliver almost boiling water (even if the water contains some steam and vapor). (If the small hot water pump is installed similar to the manner in which the cold pump is installed, hot water may not be delivered at a near-boiling point, and the pump may be sucking vapor/steam only.)

Referring to FIG. 22B, instaboil sensor 129 may be an NTC thermister, as shown. Thermister 129 may include a connector for communicating with PCB end 710 which may be an STM P24192 or equivalent, and an end 712 which may be Stainless Steel 304 material or corrosive-resistant material. Alternatively, a thermocouple may be used instead. Exemplary technical specifications for NTC thermister 129 may be: (1) zero power resistance: R25=5.000 KΩ; (2) B-value: B25/50=3970K±2%; (3) operating temperature range: −30° C.~+105° C.; (4) insulation resistance: in water 500 VDC, 100 MΩ Min.; and (5) dielectric strength: in water 1500 VDC, 1 min, no flashover (leak current: 1 mA max).

Figure 21B:
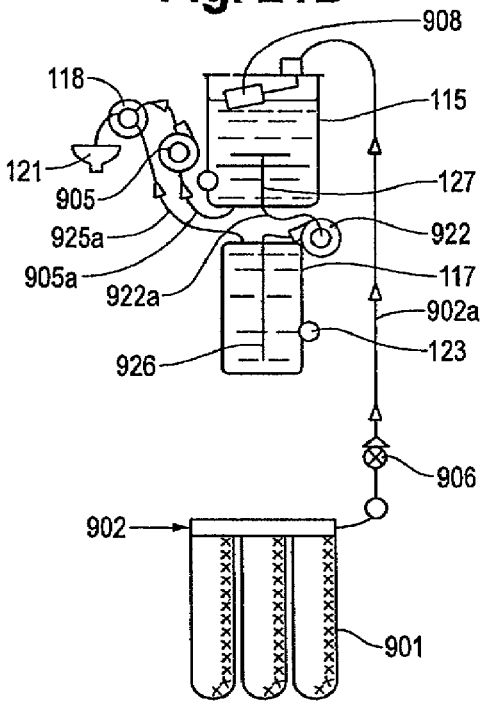

Referring to FIG. 21B, a slightly different embodiment from FIG. 9A is shown, differing only in that this embodiment lacks the instaboil feature, (i.e. there is no $SIPO_3$ generator 900, O3 diffuser 904, or instaboil sensor 129). The instaboil feature may be removed to provide a more economical cooler.

Figure 21C:
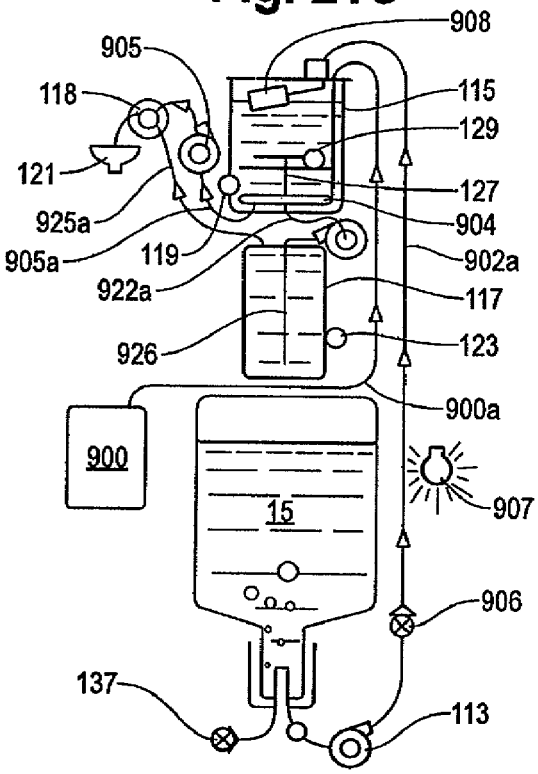

Referring to FIG. 21C, a slightly different embodiment from FIG. 21A is shown, differing only in that instead of the water originating from an outside source, such as a city water supply 902, the water is supplied from water bottle 15. This necessitates water pump 113 to carry water upwardly through conduit 920. Another slight difference is the presence of LED back light 907; with proper illumination, the user will be able to view the water level from outside of the unit through the window on the door.

Figure 21D:
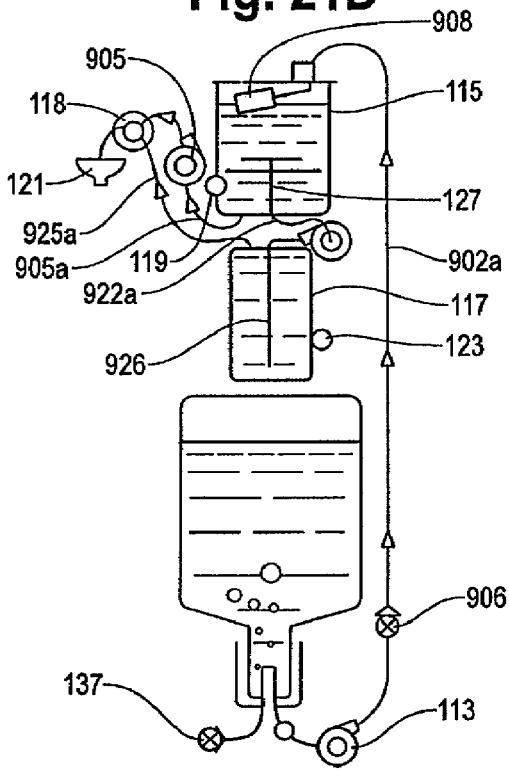

Referring to FIG. 21D, a slightly different embodiment from FIG. 21B is shown, differing only in that instead of the water originating from an outside source, such as a city water supply 902, the water is again supplied from water bottle 15.

Figure 21E:
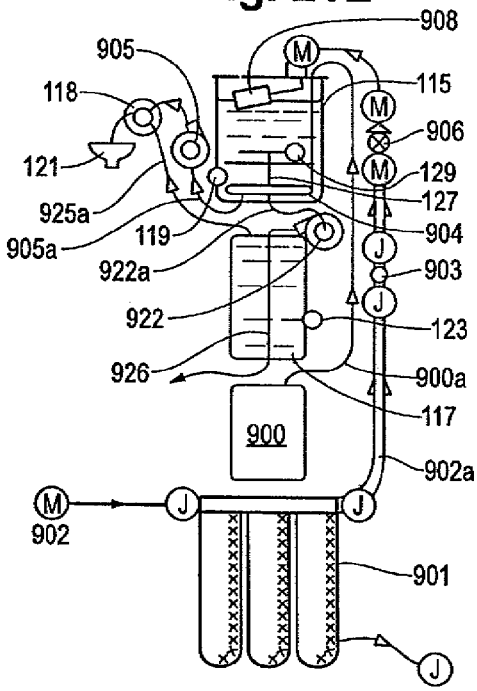

Referring to FIGS. 21E-21H slightly different embodiments from FIG. 21A are shown, with different internal routing. Referring only to FIG. 21E, a TDS module 903 may be employed.

Figure 21F:
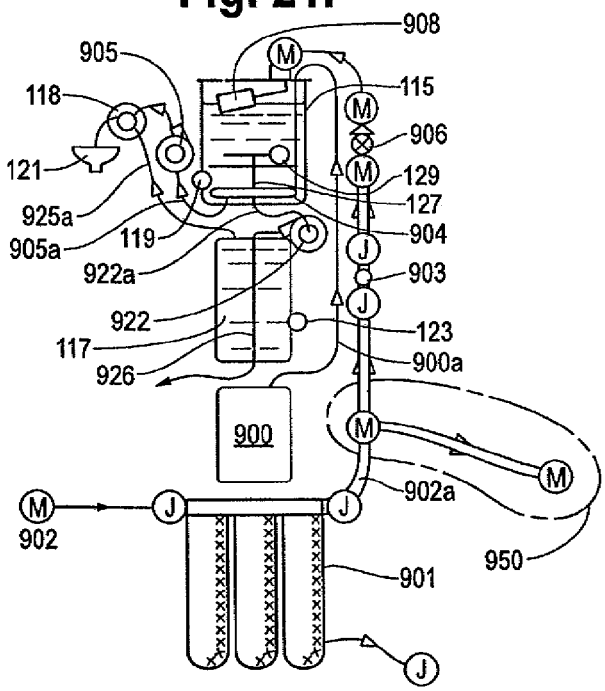

Referring to FIG. 21F a slightly different embodiment from FIG. 21E is shown, differing only in that an optional water-out port 950 is provided for supplying filtered water to a coffee machine, ice maker, or a refrigerator, for example.

Figure 21G:
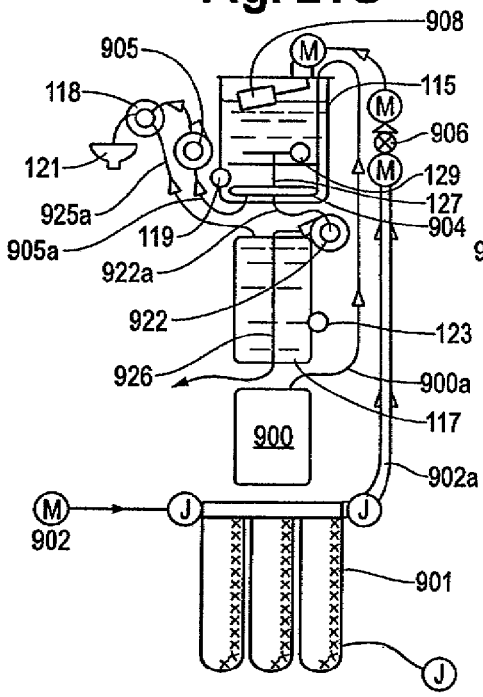
Figure 21H:
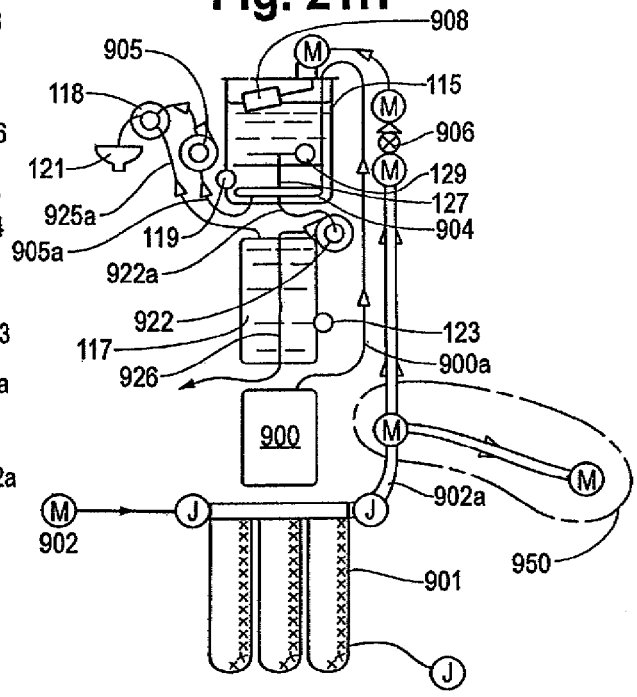

Referring to FIGS. 21G-H, these embodiments differ only slightly from FIG. 21E in that there is no TDS module 903.

Measured Fill

Figure 24:
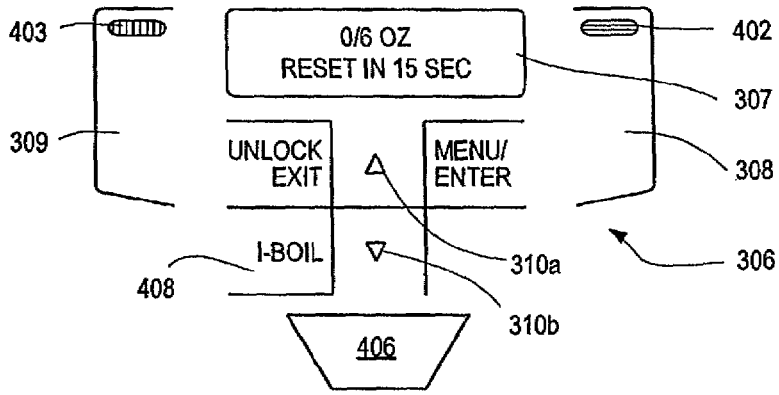
FIG. 24 is a schematic diagram of one example of a display panel of the present invention.

Referring now to FIG. 24 a measured fill feature may be provided to permit a user to choose a desired fill volume for a vessel. This may be done, for example, by depressing up and down arrows 310*a*, 301*b*, respectively, on a touch-key visual display/interface that electronically communicates with the measured fill functionality. LCD display 307, for example, may display the desired liquid volume to be dispensed, which may be adjusted upwardly or downwardly depending on how the user sets the feature. When a desired volume is displayed, the user may depress the hot (309) or cold (308) button once, and the unit will dispense the desired volume of liquid chosen by the user. Depressing any key on display panel 306 may stop the dispensing in case of an emergency (over-spillage, for example).

In a preferred embodiment, the measured fill feature may be reset to a normal dispensing mode ("on the fly") after 15 seconds of no user interaction, for example. In the normal dispensing mode, the user may press and hold down the cold (308) or hot (309) dispensing button to dispense liquid from the spout. The unit will dispense the liquid, while LCD display 307 may be programmed to show the dispensed volume in real time. When the user releases the dispensing button, dispensing will stop. A water pump, such as water pump DB-2 series with a 12V 65 ml/sec (1.7 Oz/sec) flow rate, may be used such as available from of WelliBao Motor & Electric Appliance Co., Ltd. in China.

In the preferred embodiment, the measured fill feature may utilize a time-based approach to measure dispensing volume (e.g., the water pump dispenses water at 2 ounces per second, so to dispense 6 ounces of water, the "on" time for the water pump will be 3 seconds). Alternatively, a flow-meter approach may be used, in which a flow meter is used to directly measure the liquid volume being dispensed, and send a proper signal for the PCB to determine when to cease dispensing. In yet another alternative embodiment, a weight-sensor approach may be used, in which a weight sensor is built into the tray to track the added weight while dispensing and send a proper signal for the PCB to determine when to cease dispensing.

Visual Displays

Figure 24A:
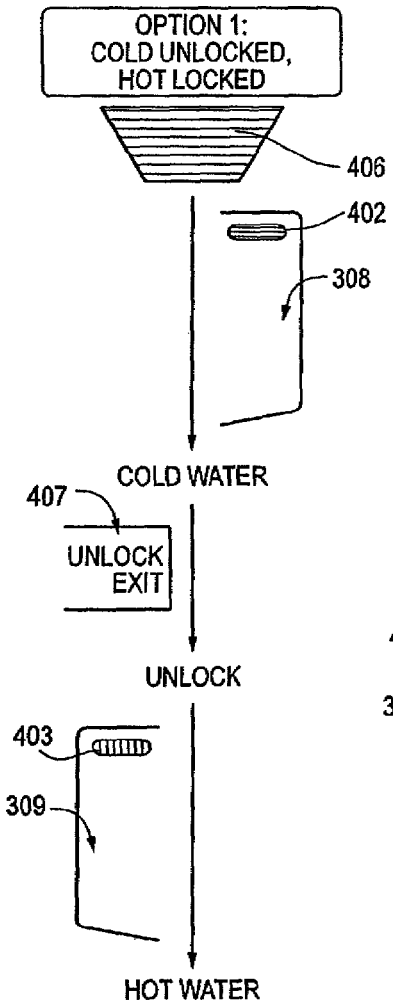
FIGS. 24A-24C are schematic diagrams illustrating examples of the lock feature of the present invention.
Figure 24B:
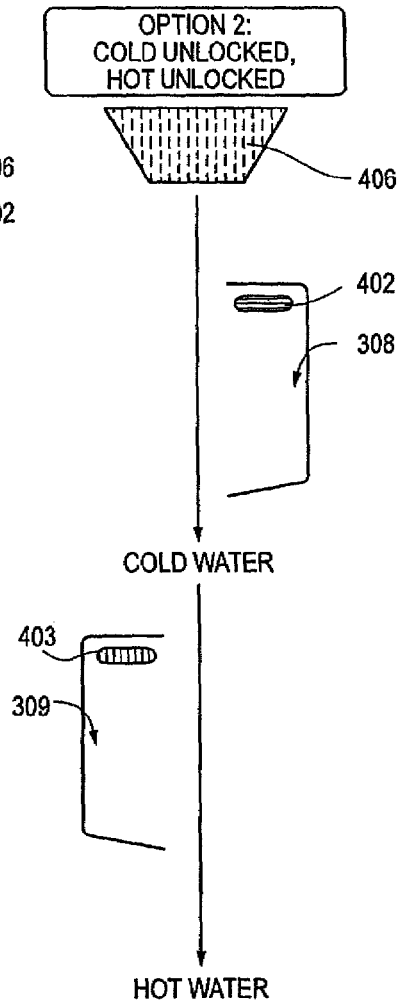
Figure 24C:
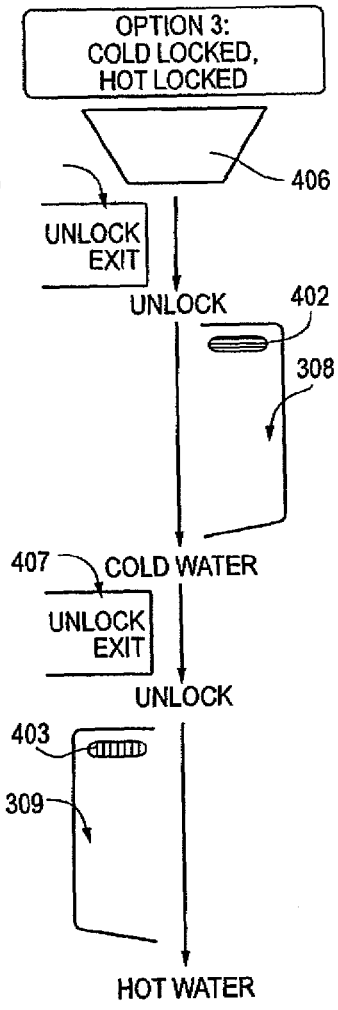

Referring now to FIGS. 24A-24C, the operation for a preferred water cooler of the present invention will now be described. The operational description is exemplary, and those of ordinary skill in the art will recognize that variations in operation and use may be provided, depending upon desired characteristics, features and modes of operation. To begin using the preferred bottom load water cooler, a user should first plug the unit into power source, and then load water bottle 15 into the unit 10 so that probe 60 engages with the neck of the water bottle. Referring now to FIG. 24, the user should wait for temperature lights 402, 403 on display panel 306 to indicate that the device is ready for use. As an example, lights to the left and right of the display may show red 403 and blue 402, for hot and cold, respectively. Cold or hot water may now be dispensed by depressing the appropriate button 308 or 309, respectively.

Referring now to FIGS. 24A-C, in one embodiment, the user may choose to have the machine locked to prevent the accidental dispensing of water. The light above spout 406 may show blue, red, or purple, for example, depending on what temperature or mode the dispenser is locked at. One option (FIG. 24A) is to have the machine in the cold unlocked, hot locked mode. The light over spout 406 may be blue in this mode: if the user now depresses cold button 308, cold water will dispense, but the hot button is locked and not operational. Now, if the user depresses unlock/exit for three seconds, for example, spout 406 turns purple. The user then depresses the hot button, and hot water will dispense.

Another option, referring now to FIG. 24B, is to have the machine in the cold and hot unlocked mode. In this mode, spout 406 shows purple: if the user depresses cold button 308, cold water will dispense; if the user depresses hot button 309, hot water dispenses. Another option is to have the machine in the hot and cold locked mode (FIG. 24C). In this mode, spout 406 shows no color: if the user depresses unlock/exit button 407 for three seconds, for example, spout 406 turns purple, and the user can depress cold button 308 to dispense the cold water; the user can then depress hot button 309, and hot water dispenses.

A visual display indicating that the "instaboil" feature has been activated may also be provided by depressing instaboil button 408 for three seconds, for example. When this button is depressed, hot water ready indicator 403 now turns off, indicating hot water is not ready to dispense. Red light 403 turns on and flashes for one minute, indicating the instaboil feature has been activated. When the instaboil feature is ready, the hot tank will return to its normal operating mode, and hot water ready indicator 403 will come back on.

Referring now to FIGS. 24A-24C, in a preferred embodiment, when display panel 306 includes an LCD display 307, it may be displayed in digital display mode or analog display mode, either of which may be programmed to display the following symbols, for example: child safety lock; SIP indicator; time; instaboil indicator; hot water temperature; and cold water temperature.

In this embodiment, and as examples, the following Error Messages may appear in LCD display 307, providing the following information to the user: PRESS AND HOLD UNLOCK FOR 3 SEC means the child safety button is locked; BOTTLE MISSING means there is no bottle in the cabinet; BOTTLE EMPTY means the bottle is empty; and SERVICE REQUIRED means that service for the machine is required.

Energy Saving Baffle

Figure 27:
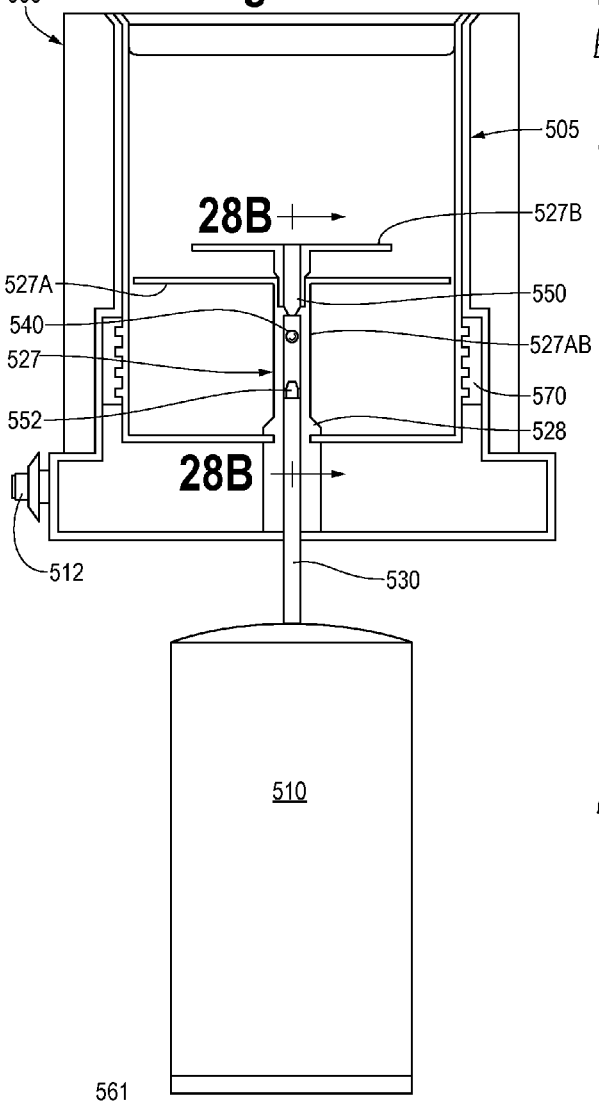
FIG. 27 is a side view of one preferred embodiment of the water cooler with energy saving baffle of the present invention.

Referring now to FIGS. 27-28, a novel, energy-saving baffle 527 is shown. Water cooler 500 includes cold tank 505, hot tank 510 and spigot 512. Similar to baffle 127 shown in FIG. 22, for example, baffle 527 may include a generally, horizontally-extending lower portion 527A and a generally, horizontally-extending upper portion 527B. Baffle lower portion 527A may be attached to or be integrally formed with a generally vertically-extending tubular portion 527AB, which may include an upper plate 550 and a lower plate 552. The general purpose of the baffle is as described above (i.e., separation of regions within the cold tank having different temperatures), and it may be used in connection with a water cooler providing the instaboil feature also described above. Evaporator 570 may be made of wound hollow copper tubing, so that the refrigerant inside can take energy/heat away from cold tank 505, and cool the water. Evaporator 570 may be press fit against the cold tank, so that it may help retain the cold tank in place (aided by baffle nut 528, per the below description).

Figure 28A:
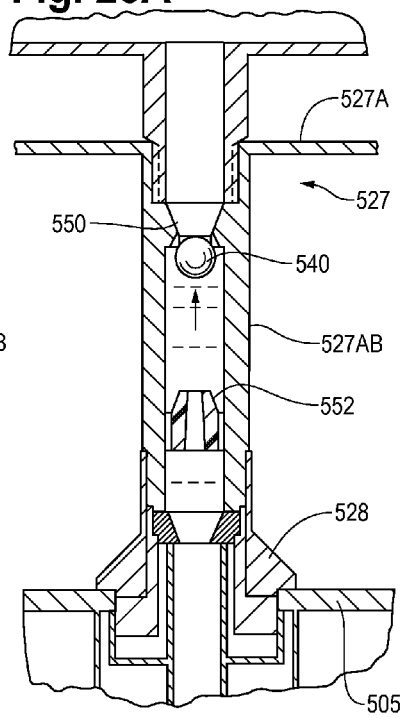
FIGS. 28A-28B are section views along line 28A/B of the water cooler and baffle design shown in FIG. 27.
Figure 28B:
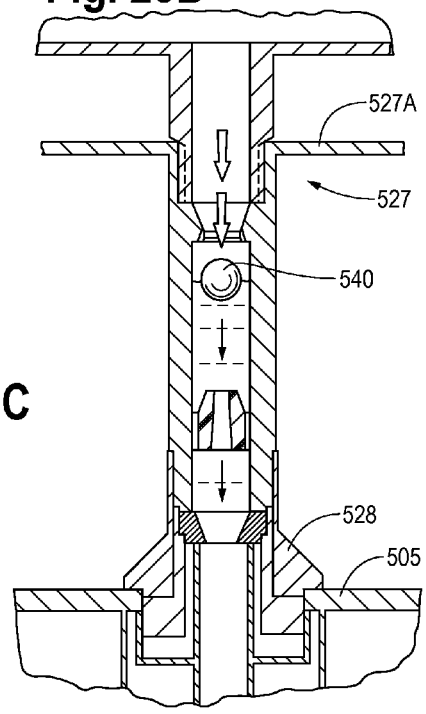
Figure 28C:
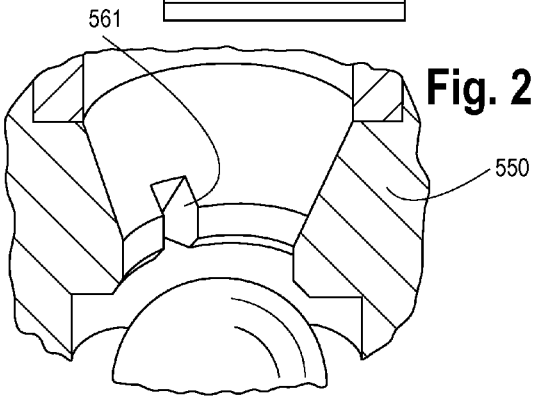
FIG. 28C is an enlarged perspective view of a portion of the upper retaining member showing the opening facilitating the partial seal of the floating ball against the upper retaining member.

Baffle 527 has a unique recirculation feature now described. Tube 530 passes from cold tank 505 to hot tank 510, enabling the controlled passage of liquid therebetween. The upper portion of tube 530 may form part of the baffle, or may be separately attached within the tubular portion 527AB of the baffle. Baffle nut 528 works like a screw nut to tread on the end of tube 530, and to secure the cold tank in place by sandwiching it, also preventing vertical movement of the baffle during use. Referring now to FIGS. 28A and 28B, a ball 540 may be provided within the tubular portion 527AB of baffle 527; the upper and lower bounds of movement of ball 540 within tube 530 may be circumscribed by upper and lower plates 550, 552. Ball 540 may be made of a plastic material, for example, with a specific density less than water or the liquid being dispensed, causing the ball to normally float up and partially seal against upper plate 550 of the baffle, restricting water circulation between the hot and cold tanks.

The term "partially seal" is used here because a full 100% seal would create a pressure vessel situation for the hot tank due to thermal expansion. To avoid this, and referring now to FIG. 28C, one or more small openings, such as slotted aperture 561, may be provided within upper plate 550 to partially relieve this pressure, ensuring that the baffle will restrict the flow without creating an undesirable pressure build-up in the hot tank. The size of opening(s) 561 may be readily determined by trial and error: if the opening/slot 561 is too large, the energy efficiency of the baffle may be substantially reduced, as water will flow through the opening too freely; if it is too small, the pressure build-up will be too great in the hot tank, potentially allowing the water to heat to a boiling condition, such that the steam will not escape rapidly enough from opening 561, pressurizing the hot tank and potentially rupturing its connected tubing.

Continuing the operation of the preferred embodiment shown in FIGS. 27-28, as hot liquid is discharged from the hot tank during normal use of the cooler, and fresh liquid such as water flows into the hot tank through tube 530 of the cold tank to replenish the hot tank, ball 540 will be moved downward by the rush of fresh liquid. Once the discharge is completed, the ball may be permitted to float back up to seal against upper retaining member 550.

The above description is not intended to limit the meaning of the words used in the following claims that define the invention. Other systems, methods, features, and advantages of the present invention will be, or will become, apparent to one having ordinary skill in the art upon examination of the foregoing drawings, written description and claims, and persons of ordinary skill in the art will understand that a variety of other designs still falling within the scope of the following claims may be envisioned and used. For example, the cradle may pivot along an axis either generally parallel or generally perpendicular to the longitudinal axis of the water cooler frame. Further, the cradle may, but need not be, attached to the door of the unit. Also, consumable liquids other than water, such as but not limited to carbonated beverages, may be dispensed. It is contemplated that these or other future modifications in structure, function or result will exist that are not substantial changes and that all such insubstantial changes in what is claimed are intended to be covered by the claims.

The following terms are used in the claims of the patent as filed and are intended to have their broadest meaning consistent with the requirements of law. Where alternative meanings are possible, the broadest meaning is intended. All words used in the claims are intended to be used in the normal, customary usage of grammar and the English language.

We claim:

1. A liquid dispensing apparatus, comprising:

cold and hot tanks in liquid communication therebetween and with a dispensing faucet, the cold tank housing a baffle in liquid communication with a tube communicating between the cold and hot tanks, the baffle separating two or more regions of liquid in the cold tank having differing temperatures and the baffle tube housing a ball with a specific density less than the specific density of the liquid, whereby the ball normally floats upward within the baffle tube to partially seal against an upper retaining member within the baffle tube and thereby restrict liquid circulation between the hot and cold tanks; and wherein the upper retaining member includes one more openings facilitating the partial seal of the ball against the upper retaining member, to thereby partially relieve pressure from liquid within the hot tank.

2. The liquid dispensing apparatus of claim 1, wherein the hot tank is located below the cold tank, and following liquid discharge from the hot tank, the ball is pushed downwardly within the baffle tube by liquid flowing from the cold tank to replenish the hot tank.

3. The liquid dispensing apparatus of claim 1, wherein the baffle includes upper and lower portions.

* * * * *

UNITED STATES PATENT AND TRADEMARK OFFICE

CERTIFICATE OF CORRECTION

PATENT NO. : 8,356,731 B2
APPLICATION NO. : 12/555866
DATED : January 22, 2013
INVENTOR(S) : Xiao et al.

It is certified that error appears in the above-identified patent and that said Letters Patent is hereby corrected as shown below:

Column 16, line 20-21, claim 1 insert --one or more-- delete "one more."

Signed and Sealed this
Nineteenth Day of January, 2016

Michelle K. Lee

Michelle K. Lee
*Director of the United States Patent and Trademark Office*